US007943538B2

(12) United States Patent
Konishi et al.

(10) Patent No.: US 7,943,538 B2
(45) Date of Patent: May 17, 2011

(54) WATER-DECOMPOSABLE CLEANING PRODUCT AND PRODUCTION METHOD THEREOF

(75) Inventors: Takayoshi Konishi, Kanonji (JP); Kazuya Okada, Kanonji (JP)

(73) Assignee: Uni-Charm Corporation, Ehime (JP)

( * ) Notice: Subject to any disclaimer, the term of this patent is extended or adjusted under 35 U.S.C. 154(b) by 748 days.

(21) Appl. No.: 11/383,028

(22) Filed: May 12, 2006

(65) Prior Publication Data

US 2006/0258251 A1 Nov. 16, 2006

(30) Foreign Application Priority Data

May 13, 2005 (JP) ..... 2005-141414

(51) Int. Cl.
*D04H 1/46* (2006.01)
*A47K 7/02* (2006.01)
*B32B 29/06* (2006.01)

(52) U.S. Cl. ..... 442/408; 442/412; 442/413; 442/415; 428/311.31; 15/229.1; 15/228; 15/226; 401/282; 401/268

(58) Field of Classification Search ..... 442/408
See application file for complete search history.

(56) References Cited

U.S. PATENT DOCUMENTS

| | | | | |
|---|---|---|---|---|
| 2,755,497 | A * | 7/1956 | Greacen, Jr. | 401/200 |
| 2,816,313 | A * | 12/1957 | Beck et al. | 15/210.1 |
| 4,995,133 | A * | 2/1991 | Newell | 15/229.1 |
| 5,789,328 | A * | 8/1998 | Kurihara et al. | 442/387 |
| 6,544,912 | B1 * | 4/2003 | Tanio et al. | 442/408 |
| 2001/0023160 | A1 * | 9/2001 | Yamada et al. | 442/413 |
| 2001/0052162 | A1 * | 12/2001 | Young | 15/229.2 |
| 2002/0054784 | A1 * | 5/2002 | Wolf | 401/282 |

FOREIGN PATENT DOCUMENTS

| | | |
|---|---|---|
| JP | 62-186833 A | 8/1987 |
| JP | 11-93055 | 4/1999 |
| JP | 2004-16637 | 1/2004 |
| JP | 3103299 | 8/2004 |
| JP | 3105217 | 10/2004 |
| JP | 2005-7094 | 1/2005 |

OTHER PUBLICATIONS

International Search Report dated Jun. 20, 2006 issued for corresponding International Patent Application No. PCT/JP2006/309244.

* cited by examiner

*Primary Examiner* — Angela Ortiz
*Assistant Examiner* — Altrev C Sykes
(74) *Attorney, Agent, or Firm* — Brinks Hofer Gilson & Lione

(57) ABSTRACT

A water-decomposable cleaning product dispersible in water, including: a cleaning part, at least a part of the cleaning part having a water-decomposable fiber-interlacing nonwoven fabric; and a holding part.

12 Claims, 10 Drawing Sheets

FIG. 8A
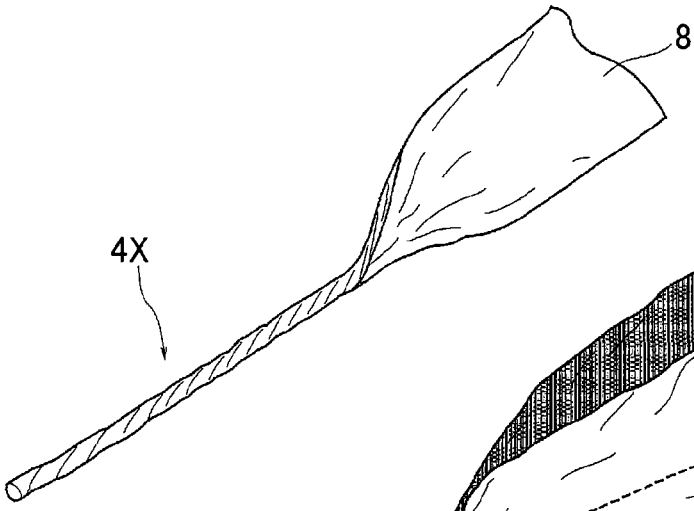
FIG. 8B
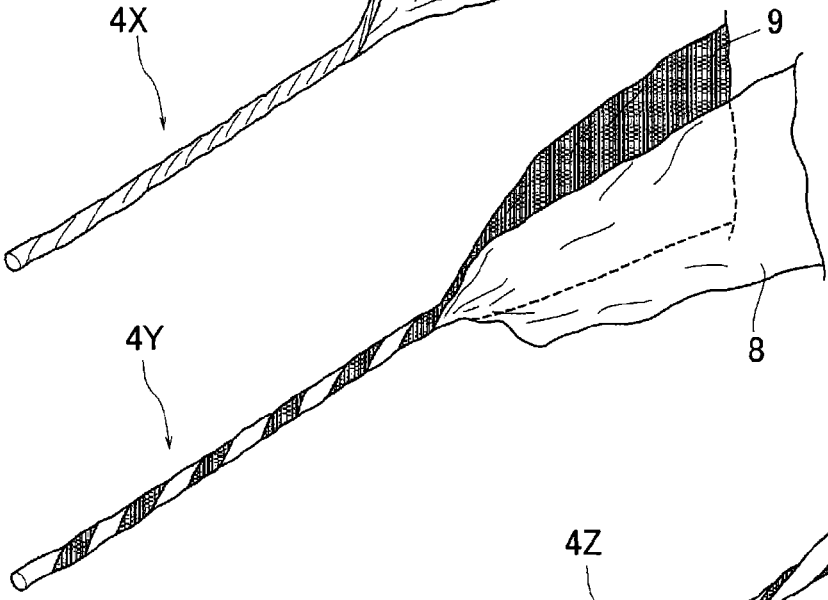
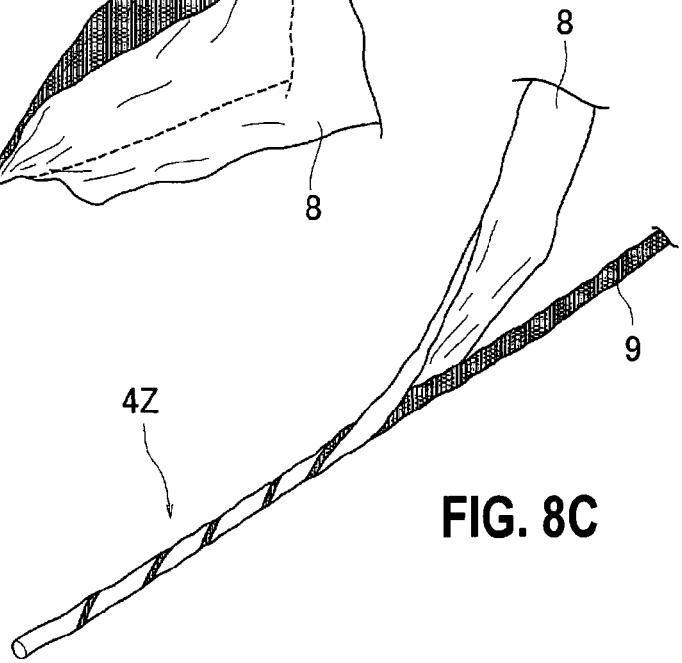
FIG. 8C

WATER-DECOMPOSABLE CLEANING PRODUCT AND PRODUCTION METHOD THEREOF

This application claims priority of Japanese Patent Application No. 2005-141414, filed May 13, 2005, which is hereby incorporated by reference in its entirety.

BACKGROUND OF THE INVENTION

1. Field of the Invention

The present invention relates to a water-decomposable cleaning product which is used to remove dirt in a place where water is used, such as in a flush toilet and which can be discarded into water after the use thereof, and a production method thereof.

2. Description of the Related Art

Japanese Patent Application Laid-Open No. Showa 62(1987)-186833 (JP62-186833) discloses a disposable toilet cleaning brush used for cleaning a flush toilet.

The toilet cleaning brush is produced using a paper comprising: i) staple fibers of a ligneous pulp and ii) a binder, such as CMC (carboxymethyl cellulose), by a method in which plural cuts are formed in the paper and the paper is wound to form a brush. The toilet cleaning brush is fixed to a head of the paper-made handhold of the brush. After the bowl is wiped with the toilet cleaning brush, the cleaning brush and the handhold together are discarded into a flush toilet and are decomposed in water. It is also described that for controlling the time needed for the dissolution of the paper in water, the surface of the brush is subjected to a wax treatment.

The JP62-186833 describes that since the time needed for cleaning a toilet bowl is such a short time as between 10 seconds and 20 seconds, before the paper constituting the toilet cleaning brush is dissolved in water, the cleaning can be accomplished.

However, the toilet cleaning brush produced with the paper itself which is produced by fixing ligneous pulp fibers through a water-soluble CMC is swollen at the contact thereof with water during the cleaning of a toilet bowl and the strength thereof is extremely lowered, so that it becomes difficult to wipe off the dirt adhered to the bowl by such a brush. With respect to the brush which has been subjected to a wax treatment, since a wax component may suppress the decomposition of the paper in water, it takes a long time until the brush has been decomposed in a purification tank or the like.

SUMMARY OF INVENTION

The present invention solves the above-noted problem accompanying the conventional arts.

It is therefore an object of the present invention to provide a water-decomposable cleaning product which can effectively wipe off the dirt adhered to the bowl of a flush toilet or the like, and a production method thereof.

It is another object of the present invention to provide a water-decomposable cleaning product which not only has a high strength when the cleaning product scrubs a toilet bowl or the like and can exhibit the effect of removing the dirt, but also can be dispersed in water within a relatively short time after the use thereof; and the production method thereof.

According to a first aspect of the present invention, there is provided a water-decomposable cleaning product dispersible in water, includes: a cleaning part, at least a part of the cleaning part including a water-decomposable fiber-interlacing nonwoven fabric; and a holding part.

According to a second aspect of the present invention, there is provided a production method of a water-decomposable cleaning product, comprising: forming a string by twining a fiber-interlacing nonwoven fabric; and arranging the plural strings in a cleaning part and adhering at least a part of the strings to each other.

According to a third aspect of the present invention, there is provided a production method of a water-decomposable cleaning product, comprising: superimposing a fiber-interlacing nonwoven fabric and a water-decomposable paper which includes cellulose fibers; forming a string by twining the fiber-interlacing nonwoven fabric and the water-decomposable paper together; and arranging the plural strings in a cleaning part and adhering at least a part of the strings to each other.

According to a fourth aspect of the present invention, there is provided a production method of a water-decomposable cleaning product, comprising: twining a water-decomposable paper including cellulose fibers; winding a fiber-interlacing nonwoven fabric around the twined water-decomposable paper; and arranging plural strings in a cleaning part and adhering at least a part of the strings to each other.

BRIEF DESCRIPTION OF THE DRAWINGS

FIG. 8A, FIG. 8B and FIG. 8C are explanatory drawings explaining three different forming methods of the string by twining only a water-decomposable sheet or a water-decomposable sheet and the water-decomposable paper together.

DESCRIPTION OF THE PREFERRED EMBODIMENTS

First Embodiment

Figure 1:
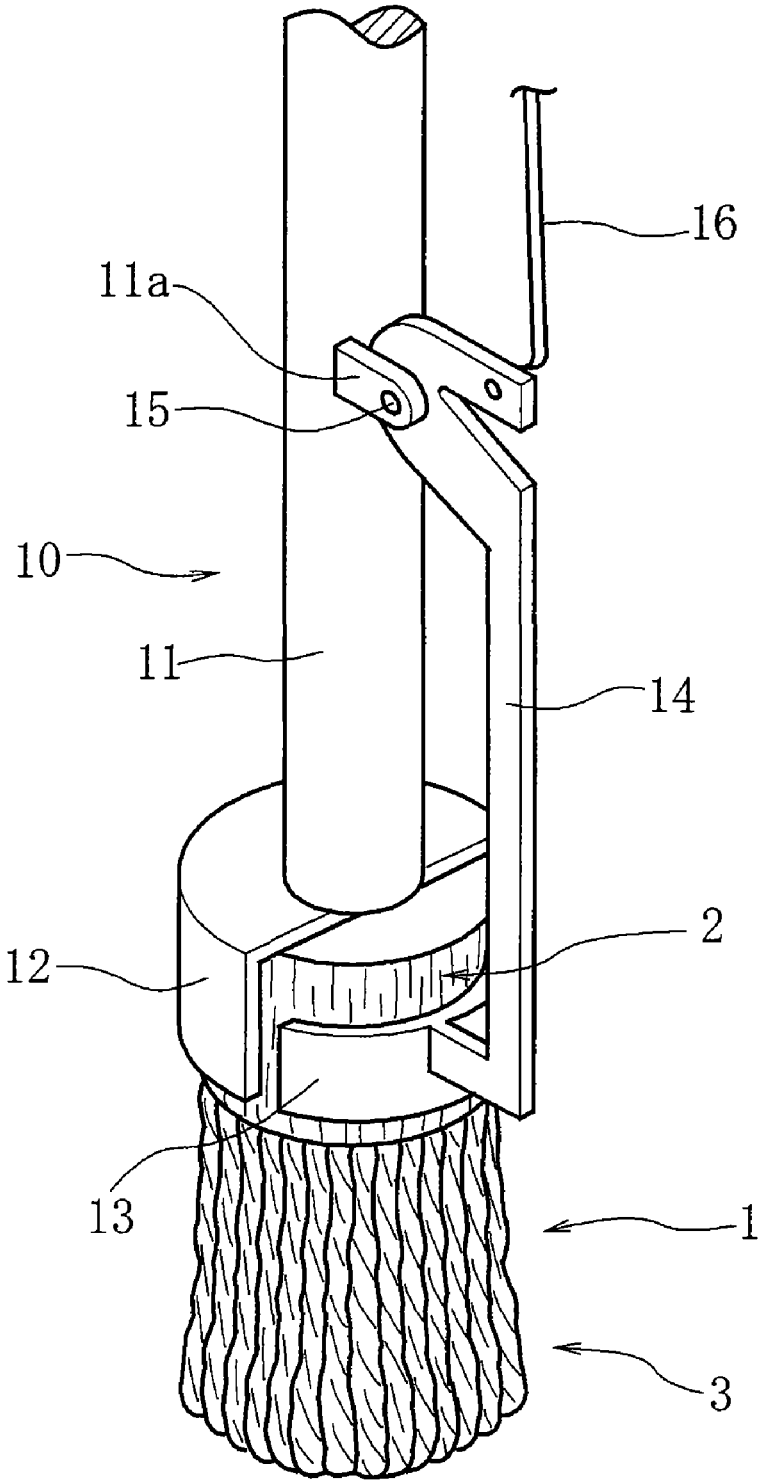
FIG. 1 is a perspective view showing the water-decomposable cleaning product according to the first embodiment of the present invention which is held by the holder.
Figure 2:
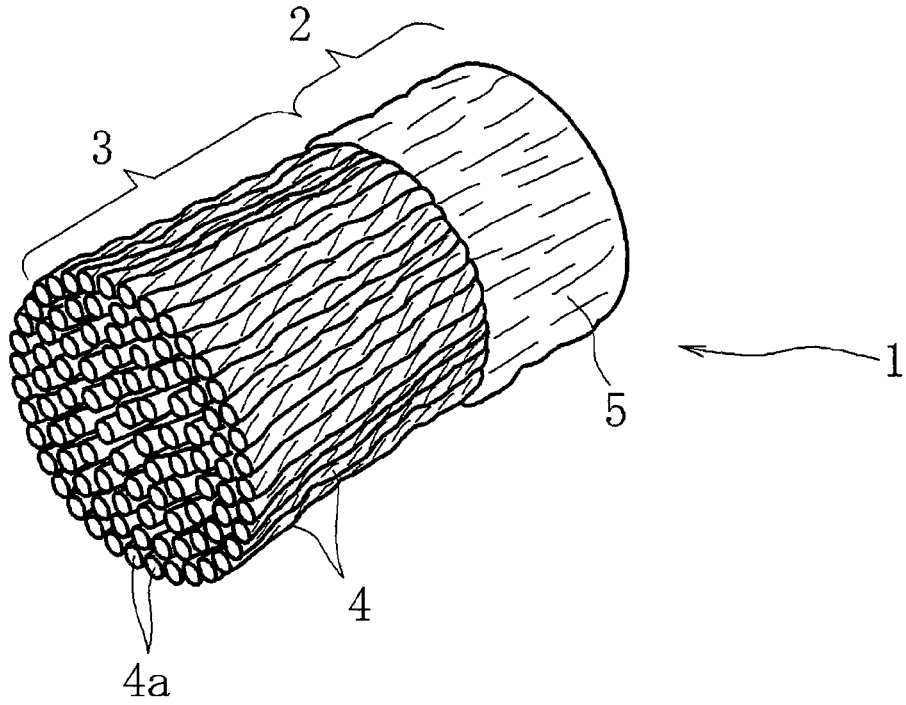
FIG. 2 is perspective view showing the water-decomposable cleaning product according to the first embodiment of the present invention.

FIG. 1 is a perspective view showing a water-decomposable cleaning product 1 which is held by a holder 10, under the present invention. FIG. 2 is a perspective view showing the water-decomposable cleaning product 1 held by the holder 10 as shown in FIG. 1, according to a first embodiment. FIG. 8A, FIG. 8B and FIG. 8C are explanatory drawings explaining, respectively, a twined string 4X, a twined string 4Y and a twined string 4Z.

As shown in FIG. 1 and FIG. 2, the water-decomposable cleaning product 1 comprises a holding part 2 and a cleaning part 3. The holding part 2 has a substantially columnar form.

In FIG. 1, the main part of the holder 10 is produced by producing integrally the handhold part 11 made of a synthetic resin and the holding part 12 attached to a terminal of the handhold part 11 and in the holder 10, the pressing part 13 made of a synthetic resin is provided at the opposite side to the holding part 12. The holding part 12 has an inside surface in the form of a half part of a concave-curved cylindrical surface and the pressing part 13 has an inside surface (which is opposite to the inside surface of the holding part 12) in the form of a half part of a concave-curved cylindrical surface, so that the inside surface of the holding part 12 and the inside surface of the pressing part 13 together form a concave-curved cylindrical surface. The holding part 12 and the pressing part 13 face each other in the diameter direction of the concave-curved cylindrical surface. The pressing part 13 is integrally produced with the lever 14, and the lever 14 is rotatably supported by the bracket 11*a* mounted on the handhold part 11 through the pivot 15. The operating wire 16 is rotatably connected to the top of the lever 14.

A torsion spring (not illustrated) is attached to the pivot 15 and by the torsion spring, the lever 14 is biased in the clockwise direction around the pivot 15 as the fulcrum, so that the pressing part 13 is biased in the direction approaching the holding part 12. A handle part (not illustrated) is provided in the upper part of the handhold part 11 and an operating lever (not illustrated) is provided in the handle part (not illustrated). The upper terminal of the operating wire 16 which is a thick wire is connected to the operating lever. When the operating lever (not illustrated) is pulled up, the pressing part 13 is spaced apart from the holding part 12. At this time, when the holding part 2 of the cleaning product 1 is inserted between the holding part 12 and the pressing part 13 and the operating lever (not illustrated) is released from the hand, by the bias force of the torsion spring (not illustrated), the holding part 2 of the cleaning product 1 is supported between the holding part 12 and the pressing part 13.

By scrubbing the part to be cleaned (such as a toilet bowl or the like) with the cleaning part 3 of the cleaning product 1 while holding the holder 10 with the cleaning product 1, the dirt adhered to the surface of the bowl or the like can be removed. At this time, it is also possible that the cleaning part 3 is wetted by the water standing in the bowl, and the bowl is wiped by the wetted cleaning part 3. After the completion of the cleaning, by discharging the pressing force of the pressing part 13 through pulling up the operating lever, the cleaning product 1 can be discarded into the bowl without touching the cleaning product 1 by the hand.

As shown in FIG. 2, the cleaning product 1 comprises a bundle of the plural strings 4. The cut end face 4*a* of the strings 4 are turned to the head of the cleaning part 3 and in the cleaning part 3, the individual strings 4 are not adhered to each other and can move independently. In the holding part 2, the base parts of the individual strings 4 are adhered to each other through a water-soluble adhesive and further, around the bundle of the strings 4, the holding material 5 is wound and adhered thereto through a water-soluble adhesive. By the way, it is also possible that the individual strings 4 in the holding part 2 are not adhered to each other and only by winding the holding material 5 around the bundle of the strings 4, the columnar form of the cleaning product 1 can be maintained.

FIG. 8A, FIG. 8B and FIG. 8C show the structure and the forming method of the twined string 4X, the twined string 4Y and the twined string 4Z for forming the string 4 individually according to the difference in structure. The string 4 used for producing the cleaning product 1 comprises any one of the twined string 4X, the twined string 4Y and the twined string 4Z. In addition, the string 4 used for producing the cleaning product 1 may comprise also a combination of 2 or more of the twined string 4X, the twined string 4Y and the twined string 4Z.

The twined string 4X shown in FIG. 8A is formed by twisting the water-decomposable sheet 8 in a belt form which has a predetermined width in one direction. The water-decomposable sheet 8 comprises a water-decomposable fiber-interlacing nonwoven fabric so that a high wet strength of the twined string 4X can be maintained. The fiber-interlacing nonwoven fabric can be produced by interlacing the fibers in such a manner that the fibers having a fiber length of 20 mm or less are laminated on a conveyor of a porous plate in the form of a mesh and the laminated fibers are subjected to a water-jet treatment to interlace the fibers.

The fiber-interlacing nonwoven fabric comprises i) fibers having a fiber length of, for example, 20 mm or less which fibers can be interlaced by the water-jet treatment, and ii) pulp fibers which are natural fibers. When the nonwoven fabric comprises pulp fibers and fibers having a fiber length of 20 mm or less which can be interlaced, by a water-jet treatment, not only are the fibers other than the pulp fibers interlaced, but the pulp fibers are also hydrogen-bonded to each other and to the other fibers which can be interlaced. This fiber-interlacing nonwoven fabric can maintain a high dry strength thereof through the hydrogen bond force of the pulp fibers and can maintain a high wet surface strength thereof through the interlacing force between the fibers. When the cleaning product is discarded into water and contacts a lot of water, due to the separation of the individual pulp fibers from each other, the twine of the string is loosened and the interlacing force of the fibers which can be interlaced is loosened, so that the individual fibers are separated from each other within a relatively short time.

As the other fibers which have a fiber length of 20 mm or less and can be interlaced by the water-jet treatment, biodegradable fibers are preferably used. Preferred examples of the biodegradable fibers include regenerated cellulose fibers, such as viscose rayon fibers, solvent spinning rayon fibers, polynosic rayon fibers, copper-ammonia rayon fibers and alginate rayon fibers. Examples of the other fibers which have a fiber length of 20 mm or less and can be interlaced by a water-jet treatment include synthetic resin fibers, such as polyethylene terephthalate (PET) fibers, nylon fibers and polypropylene (PP) fibers.

Examples of the fibers which may be used either in combination with the pulp fibers or instead of the pulp fibers include natural fibers, such as hemp, cotton, bagasse, banana, pineapple and bamboo.

Further, i) fibers of polyvinyl alcohol (PVA) which is a water-soluble resin and ii) water-soluble or water-swellable carboxyl methyl cellulose (CMC) may be added as a binder into the composition of the fiber-interlacing nonwoven fabric for enhancing the dry strength of the water-decomposable sheet 8, or such a binder may be added to the twined string 4X which has been formed, for easier maintaining of the twined form of the string.

In place of the above pulp fiber or in combination with the above pulp fiber, a fiber-interlacing nonwoven fabric produced by the following method can be also used:

1) preparing fibrillated rayon fibers in such a manner that, in the surfaces of the fibers, a lot of microfibers having a fiber length of 1 mm or less are peel-formed by beating the rayon fibers having a fiber length of from 3 mm to 7 mm, 2) papermaking, in a wet system, one of the following i) and ii):

i) interlaceable fibers (e.g., rayon fibers), pulp fibers and fibrillated rayon fibers, and ii) interlaceable fibers and fibrillated rayon fibers, and 3) then, subjecting the resultant fibers to a water-jet treatment.

Since in this nonwoven fabric, the fibers are tightly fixed to each other through the hydrogen bond force of the fibrillated rayon fibers, the dry strength and the wet strength of this nonwoven fabric can be enhanced, and when the cleaning product contacts a lot of water, the fibrillated rayon fibers are dispersed, so that the cleaning product can be water-decomposed within a short time.

The fiber-interlacing nonwoven fabric constituting the twined string 4X comprises i) preferably 10% by mass or more of natural fibers, such as pulp fibers and ii) 10% by mass or more of fibers such as rayon fibers having a fiber length of 20 mm or less and interlaceable by a water-jet treatment. By comprising 10% by mass or more of natural fibers, the dry strength of the water-decomposable sheet 8 can be enhanced and the twined form of the twined string 4X after strongly twining can be maintained through the hydrogen bond force of the fibers. Further, by comprising 10% by mass or more of the fibers which can be interlaced, the wet strength of the water-decomposable sheet 8 can be enhanced.

The water-decomposable sheet 8 comprising a fiber-interlacing nonwoven fabric has a weight per square-meter of preferably 30 g/m$^2$ or more, more preferably 50 g/m$^2$ or more and a thickness of preferably from 0.1 mm to 0.5 mm. When the weight per square-meter is less than 30 g/m$^2$, not only the wet strength of the water-decomposable sheet 8, but also the strength of the string 4 is lowered. The upper limit of the weight per square-meter is not particularly defined; however, so that the time needed for the water-decomposable sheet 8 to decompose in water is 700 sec or less, the upper limit of the weight per square-meter is preferably about 120 g/m$^2$.

In FIG. 8A, the twined string 4X is formed using one water-decomposable sheet 8 comprising a fiber-interlacing nonwoven fabric; however, the twined string 4X may be formed using plural water-decomposable sheets 8 which are superimposed. For enhancing the strength of the cleaning product during the cleaning by thickening the individual strings 4 used for producing the cleaning product 1 shown in FIG. 2, it is satisfactory to increase the weight per square-meter and the thickness of one water-decomposable sheet 8; however, as described above, when the weight per square-meter is more than 120 g/m$^2$, it is feared and not preferred that the time needed for the water-decomposition of the cleaning product in a digestion tank or the like is more than 700 sec. Further, when the weight per square-meter and the thickness of one water-decomposable sheet 8 are increased excessively, the water-decomposable sheet 8 becomes unlikely to be twined during the twisting step. Therefore, for thickening the string 4, it is preferred that the twined string 4X is formed using the plural water-decomposable sheets 8 having a weight square-meter of from 30 g/m$^2$ to 120 g/m$^2$.

The twined string 4Y shown in FIG. 8B is formed by a method in which the water-decomposable sheet 8 comprising a fiber-interlacing nonwoven fabric and the water-decomposable paper 9 are superimposed and twined together. The water-decomposable paper 9 is produced by papermaking natural fibers, such as pulp fibers or by papermaking natural fibers, such as pulp fibers and regenerated cellulose fibers, such as rayon fibers, so that the water-decomposable paper 9 exhibits the strength thereof through the hydrogen bond force between fibers.

By twining together the water-decomposable sheet 8 and the water-decomposable paper 9 which are superimposed, the superimposed sheets can be strongly and tightly twisted and twined because of a high strength of the water-decomposable sheet 8 comprising a fiber-interlacing nonwoven fabric. After the twining, the twined string can maintain the form thereof obtained through the twining in a dry state, due to the hydrogen bond force of the fibers constituting the water-decomposable paper 9. Accordingly, the twined string 4Y having a high density can be easily processed and can maintain the twined form thereof. By forming the string 4 of the cleaning product 1 shown in FIG. 2 using the twined string 4Y having a high density, even when the string 4 contains little water, the dirt adhered to the surface of a toilet bowl or the like can be scrubbed off by the string 4 having a high stiffness. When the cleaning product is discarded into a flush toilet and contacts a lot of water, the fibers constituting the water-decomposable paper 9 are loosened and the twine of the string 4 begins to be loosened, consequently the water-decomposable sheet 8 is loosened.

In the twined string 4Y shown in FIG. 8B, the water-decomposable paper 9 is colored in a color other than white, such as blue and red. The water-decomposable sheet 8 comprising a fiber-interlacing nonwoven fabric is formed with white fibers. By twining the water-decomposable sheet 8 and the water-decomposable paper 9 which are superimposed, a colored part and a white part are located alternately in the twined string 4Y, so that the appearance of the twined string 4Y becomes preferable.

In the forming of the twined string 4Y shown in FIG. 8B, instead of the water-decomposable paper 9, an air-laid nonwoven fabric can be used. The air-laid nonwoven fabric is produced by a method in which a fiber web is produced by laminating pulp fibers according to an air-laid method and the fibers in the fiber web are adhered to each other through a water-soluble binder, such as PVA (polyvinyl alcohol). The air-laid nonwoven fabric has, for example a weight per square-meter of from 20 g/m$^2$ to 80 g/m$^2$ and such a low density as a fiber density of from 0.04 g/cm$^3$ to 0.07 g/cm$^3$, and is so bulky as having a thickness of from 0.3 mm to 5 mm. In addition, the air-laid nonwoven fabric can be decomposed in water within a short time. Since the air-laid nonwoven fabric has cushion properties, by twisting together i) the air-laid nonwoven fabric and ii) the water-decomposable sheet 8 which comprises a fiber-interlacing nonwoven fabric, a twined string which has elasticity can be obtained.

The twined string 4Z shown in FIG. 8C is formed by the following method: 1) twining one of the following to thereby form the core of the string 4Z: i) one water-decomposable paper 9, ii) the plural water-decomposable papers 9, iii) the air-laid nonwoven fabric, and iv) the water-decomposable paper 9 and the air-laid nonwoven fabric which are superimposed, 2) winding around the core the water-decomposable sheet 8 comprising a fiber-interlacing nonwoven fabric, and 3) further twining the water-decomposable sheet 8. Since the core of the twined string 4Z exhibits a strong hydrogen bond force and the twisted form thereof can be maintained, the twined string 4Z has a high density. Since the water-decomposable sheet 8 having a high wet strength is wound around the core, the surface strength of the string 4 can be enhanced and the form of the string 4 can be easily maintained when scrubbing-off dirt while the cleaning product is in a wet state. In addition, when the cleaning product contacts a lot of water, the water-decomposable paper 9 or the air-laid nonwoven fabric which constitute the core is decomposed and consequently, the twine of the water-decomposable sheet 8 is loosened, so that the cleaning product becomes able to be water-decomposed within a short time.

The number of twining times for forming each of the twined string 4X, the twined string 4Y and the twined string 4Z is preferably from 4 times to 30 times per 25 cm of the water-decomposable sheet constituting the twined string. When the twining times are less than 4 times, the density of the twined string becomes too low, so that the string cannot bear a frictional force during the wiping of the dirt and is easily broken. On the other hand, when the twining times are more than 30 times, a load is charged to the water-decomposable sheet during the twining thereof, so that it is feared that the sheet is cut. The thickness of the twined string 4X, the twined string 4Y and the twined string 4Z is preferably in the range of from 1 mm to 10 mm. When the thickness is in this range, i) the touch of the string 4 wiping the part to be cleaned is preferable, and ii) when the cleaning product is discarded into a flush toilet, the piping is not clogged by the cleaning product, so that the cleaning product can be easily discarded.

The string 4 constituting the cleaning product 1 shown in FIG. 2 is formed by a method in which at least one of the twined string 4X, the twined string 4Y and the twined string 4Z is cut into a length of 30 mm to 100 mm and 5 to 50 strings having substantially the same length are bundled-up to form the string 4. While lining up the cut end faces 4*a* of the strings 4, in the holding part 2, the base parts of the strings 4 are adhered to each other through a water-soluble adhesive, such as PVA and further, around the bundle of the strings 4, the water-decomposable holding material 5 is wound and adhered thereto through a water-soluble adhesive. In the cleaning part 3, the individual strings 4 can move independently.

Since during the use of the cleaning product 1, the holding part 2 of the cleaning product 1 is held between the holding part 12 and the pressing part 13 of the holder 10 shown in FIG. 1, even when the holding part 2 is wetted by water during the cleaning, the strings 4 can be prevented from being easily separated from each other in the holding part 2. Therefore, it is satisfactory that in the holding part 2, a fixing force having such a level that the strings 4 are not separated from each other not only until the cleaning product is fitted to the holder 10, but also in a dry state, is charged to the strings 4, and the holding material 5 wound around the bundle of the strings 4 in the holding part 2 may comprise the same paper material as that used for the production of the water-decomposable paper 9. The water-decomposable holding material 5 may comprise a water-decomposable film, such as a PVA film. Otherwise, instead of using the holding material 5, the holding part 2 may be formed by bundling up the strings 4 and by compressing, or heating and compressing the bundle of the strings 4, so that the hydrogen bond force between the strings 4 is enhanced in the holding part 2.

The cleaning part 3 may be formed by adhering the strings 4 to each other through a water-soluble adhesive or by bonding the strings 4 to each other through the hydrogen bond force between the strings. In this case, when a toilet bowl or the like is wiped by the cleaning part 3 and the cleaning part 3 contacts water, individual strings 4 can move independently and the wiping is performed by the individual independent strings 4.

When the fixing force between the strings 4 in the holding part 2 is weakened, the water-decomposition time in which the strings 4 are separated from each other in the cleaning part 2 becomes shorter than the water-decomposition time in which the string 4 itself is water-decomposed into individual fibers. When the cleaning product 1 is discarded into a flush toilet or the like and contacts a lot of water, immediately, the adhering force between the strings 4 in the holding part 2 is discharged and the strings 4 are separated into individual strings 4, and thereafter, the individual strings 4 can be water-decomposed within a short time.

The time needed for the water-decomposition of the individual strings 4 is preferably 700 sec or less, more preferably 600 sec or less, still more preferably 300 sec or less, in terms of the value measured according to JIS P4501 (relaxability test for the toilet paper), based on 100 mm of the length of one piece of the string 4. This is a measurement from i) a time when the string 4 is charged into 300 mL of an ion-exchanged water having a temperature of 20±5° C. which is placed in a 300 mL beaker, and then the string 4 and the ion-exchanged water together are stirred by rotating a rotator at a speed of 600 rpm in the ion-exchanged water, to ii) a time when the form of the string has disappeared and the form of the sheet has not remained, so that individual fibers have been dispersed.

Method of Use

Next, with respect to the method of using the cleaning product 1, explanations are given.

While holding the holding part 2 of the cleaning product 1 shown in FIG. 2 between the holding part 12 and the pressing part 13 of the holder 10 shown in FIG. 1, the cleaning is performed by scrubbing with the cleaning part 3 the inside of the bowl of a flush toilet. At this time, by wiping the toilet bowl with the cleaning part 3 which is wetted by a flush water in the flush toilet, the dirt can be effectively removed. The string 4 is formed by twining the water-decomposable sheet 8 or by twining a combination of the water-decomposable sheet 8 and the water-decomposable paper 9, and comprises fibers having a high density, a high stiffness and elasticity. Further, in the surface of the string 4, an unevenness is formed by the twining. Accordingly, by this string 4, the dirt adhered to a toilet bowl can be effectively removed. Particularly, since the string 4 comprises a fiber-interlacing nonwoven fabric and consequently, the string 4 has a high surface strength and is not worn out during the cleaning, the string 4 can easily maintain the form thereof. Since the cleaning part 3 comprises the plural strings 4, the individual strings 4 can independently move on the surface of the part to be cleaned such as a toilet bowl, and the cleaning part 3 spreads through the moving of the individual strings 4 in which the individual strings 4 are separated from each other by the pressure charged to the cleaning product 1 during the cleaning, so that a toilet bowl or the like can be easily cleaned to every corner.

After the cleaning is accomplished, when the pressing part 13 of the holder 10 is parted from the holding part 12, the cleaning product 1 is dropped into a flush toilet and the cleaning product 1 can be flushed away together with a flush water. Since in water, the fixing force of the holding part 2 is discharged and individual strings 4 are dispersed, the piping is not clogged by the strings 4 and the flush water can flow. Thereafter, in the piping or in a digestion tank, the string 4 is decomposed into individual fibers.

Modifications to First Embodiment

Figure 3:
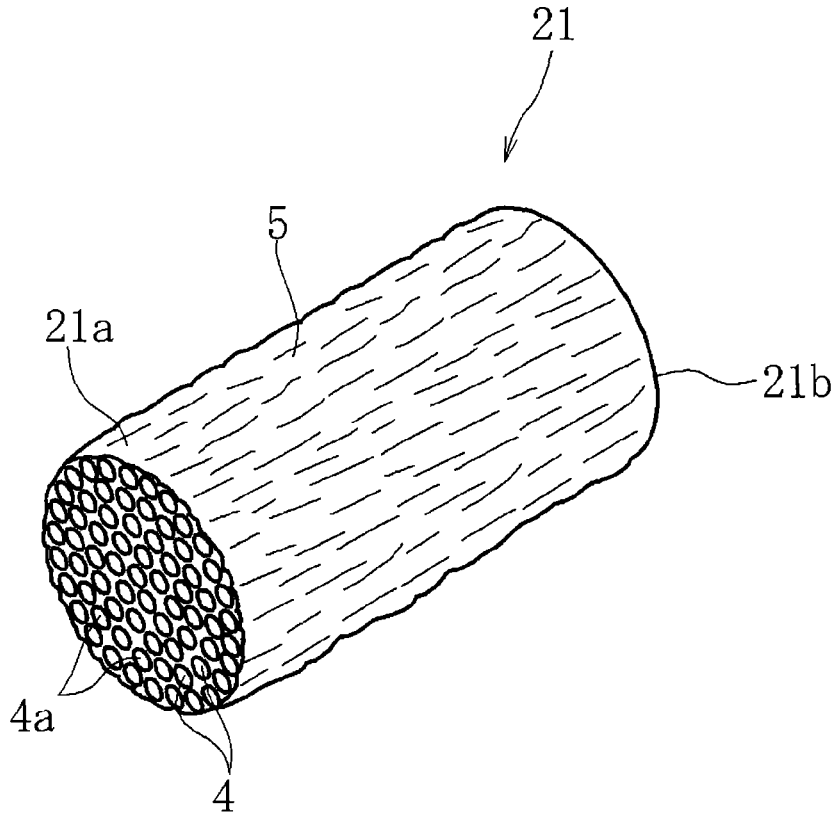
FIG. 3 is a perspective view showing another form of the water-decomposable cleaning product according to the first embodiment of the present invention.
Figure 4:
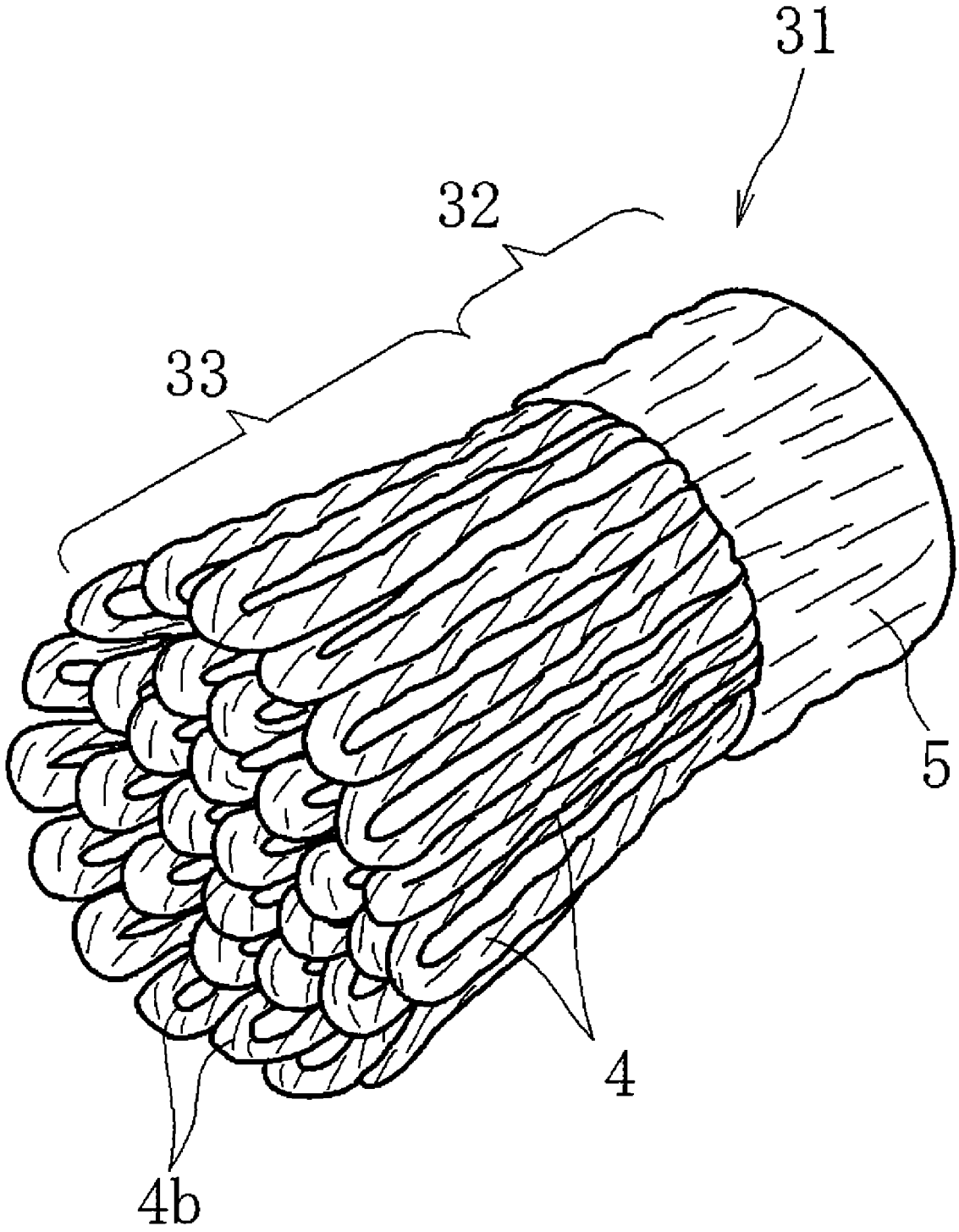
FIG. 4 is a perspective view showing still another form of the water-decomposable cleaning product according to the first embodiment of the present invention.
Figure 5:
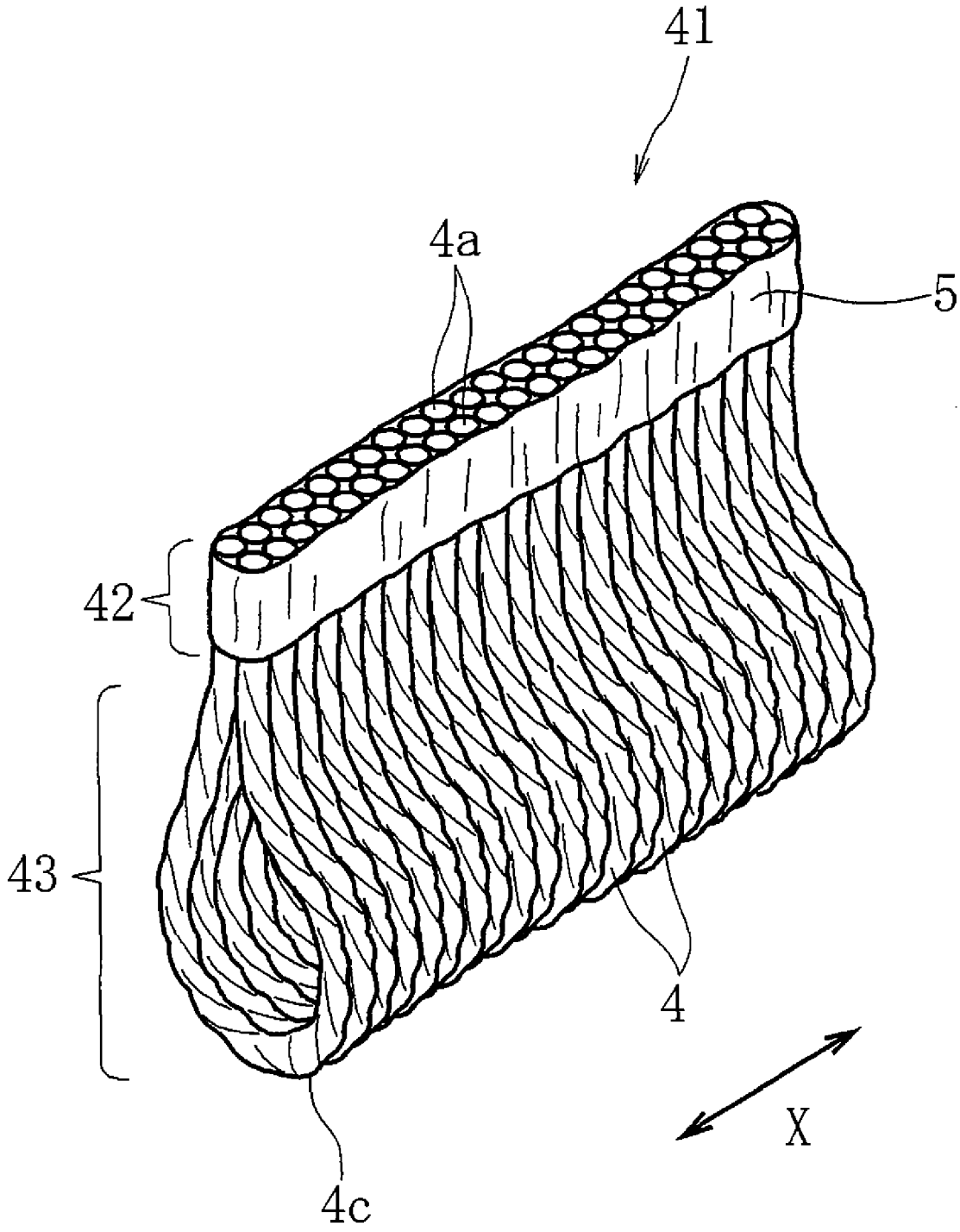
FIG. 5 is a perspective view showing still another form of the water-decomposable cleaning product according to the first embodiment of the present invention.

FIG. 3 to FIG. 5 are perspective views showing other forms of the water-decomposable cleaning product 1 according to the first embodiment of the present invention.

The cleaning product 21 shown in FIG. 3 is produced by a method comprising: bundling-up the strings 4 having a predetermined length; winding the water-decomposable holding material 5 around the bundle of the strings 4 over the whole length of the bundle of the strings 4; and adhering the holding material 5's inner face and the bundle of the strings 4 to each other through a water-soluble adhesive. In the cleaning product 21, any one of the terminal 21*a* and the terminal 21*b* can be used as a holding part and the other one can be used as a cleaning part. In other words, in the cleaning product 21, any one of the terminal 21*a* and the terminal 21*b* can be held between the holding part 12 and the pressing part 13 of the holder 10. In this alternate form of the first embodiment, the holding part and the cleaning part may have the same structure.

In the cleaning product 21, the individual strings 4 may be not adhered to each other. By winding the bundle of the strings 4 with the holding material 5, the cleaning product 21 can maintain the form thereof shown in FIG. 3 until the cleaning product 21 is held by the holder 10. By holding any one of the terminal 21*a* and the terminal 21*b* between the holding part 12 and the pressing part 13 of the holder 10, even when thereafter, the holding material 5 is wetted by water and is water-decomposed, the base parts of the strings 4 are bundled up and are held between the holding part 12 and the pressing part 13, so that the cleaning product 21 can maintain the form of a bundle. In addition, when the holding material 5 is wetted by water and is water-decomposed, in a part of the cleaning product 21 which is not held by the holder 10, the individual strings 4 become able to move freely, so that the part to be cleaned can be wiped by the individual strings 4.

The cleaning product 31 shown in FIG. 4 is produced by a method comprising: folding the individual strings 4 into halves at the center thereof in the longitudinal direction; bundling-up the base parts of the individual strings 4 in the holding part 32 and adhering the base parts of the individual strings 4 to each other through a water-soluble adhesive; and winding the holding material 51 around the bundle of the strings 4 and adhering the holding material 51 thereto. The folded parts 4*b* of the strings 4 are exposed at the head of the cleaning part 33 and the individual strings 4 can move independently in the cleaning part 33.

In the cleaning product 31, since the folded parts 4*b* of the strings 4 are located in the cleaning part 33 and no cut end face 4*a* of the strings 4 is exposed in the cleaning part 33, even when the head of the cleaning part 33 contacts water and the folded parts 4*b* are wetted by water, the twine of the string 4 is unlikely to be loosened and the stiffness of the string 4 can be maintained for a relatively long time. Therefore, the removal of the dirt adhered to the part to be cleaned by scrubbing with the folded part 4*b* can be easily performed.

The cleaning product 41 shown in FIG. 5 is produced by a method comprising: bending the individual strings 4 into a loop form; lining-up the cut end faces 4*a* of the individual strings 4 and adhering the individual strings 4 to each other through a water-soluble adhesive; and winding the holding material 5 around the bundle of the strings 4 and adhering the holding material 5 thereto through a water-soluble adhesive, thereby forming the holding part 42 in a flat form. In the cleaning part 43, the individual strings 4 can move freely and at the head of the cleaning part 43, where the loop parts 4*c* formed by bending the strings 4 are located. In the holding part 42, the bundle of the strings 4 and the holding material 5 may be compressed, or heated and compressed into a flat form, so that the individual strings 4 are hydrogen-bonded to each other, or the holding material 5 may be not used. In this case, a holder in which the holding part 12 and the pressing part 13 shown in FIG. 1 have the flat inside surfaces thereof which face to each other, is used.

Second Embodiment

Figure 6:
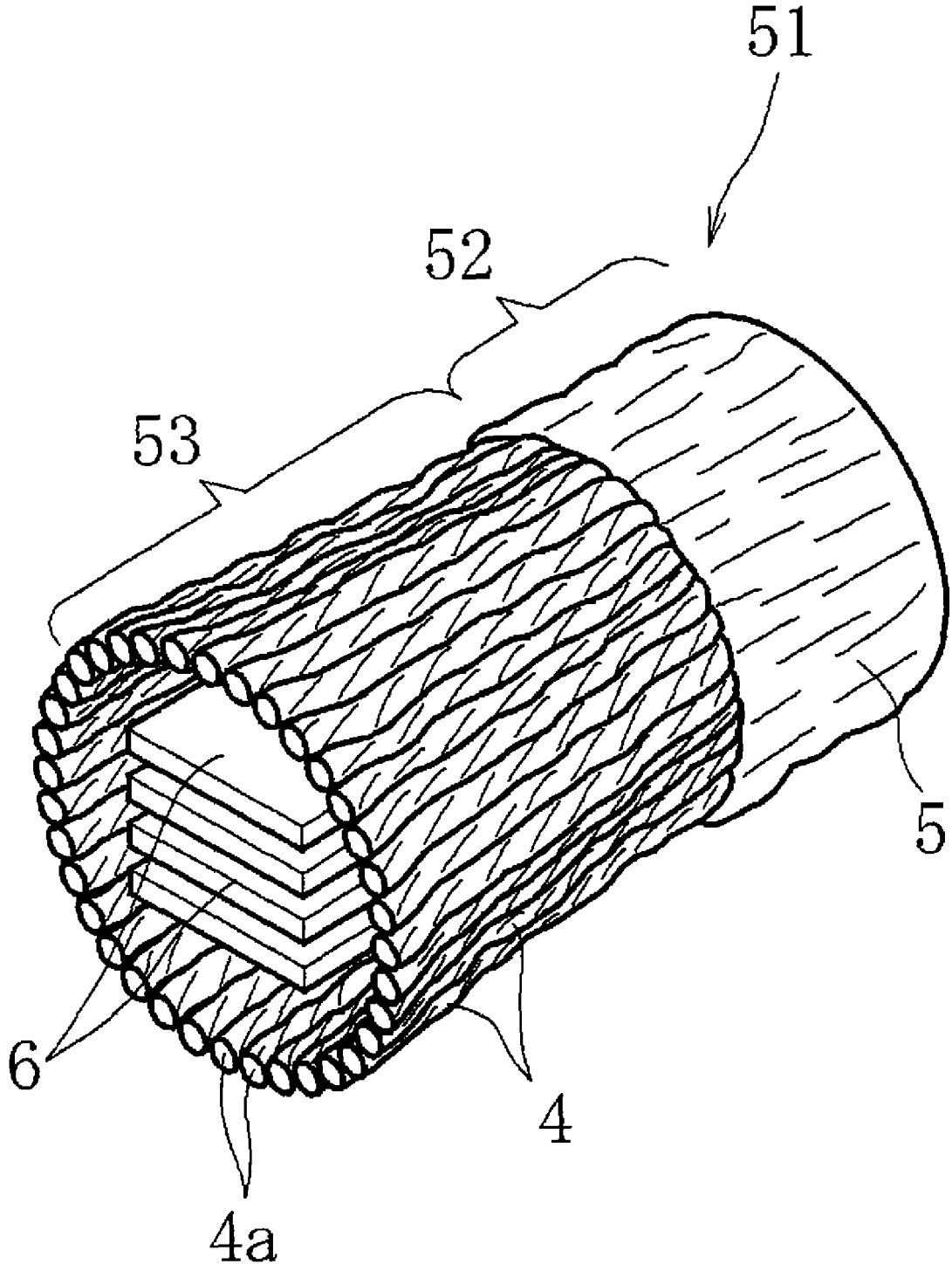
FIG. 6 is a perspective view showing the water-decomposable cleaning product according to the second embodiment of the present invention.
Figure 7:
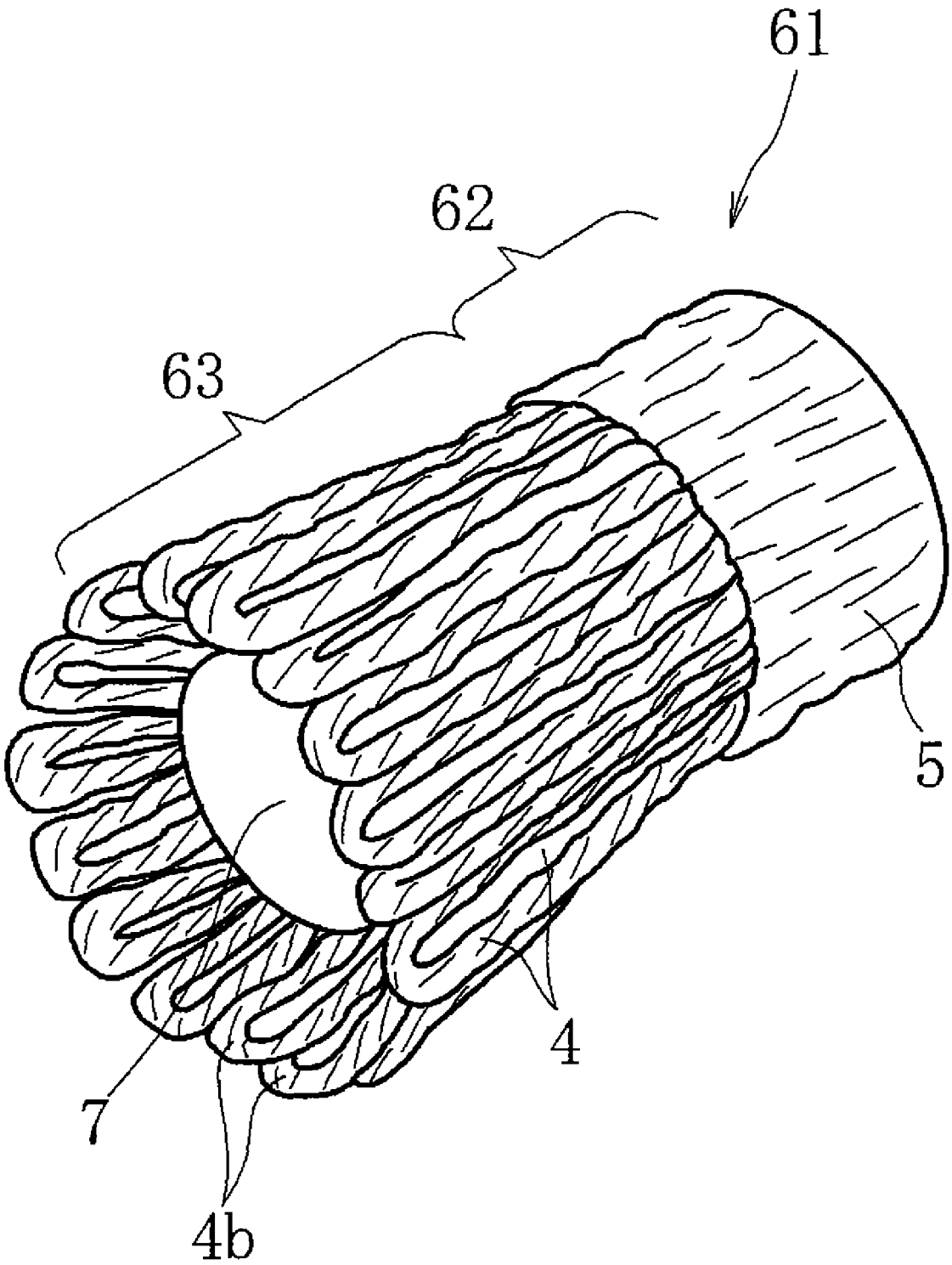
FIG. 7 is a perspective view showing another form of the water-decomposable cleaning product according to the second embodiment of the present invention.

FIG. 6 is a perspective view showing the water-decomposable cleaning product 51 according to the second embodiment of the present invention; and FIG. 7 is a perspective view showing the water-decomposable cleaning product 61 according to another form of the second embodiment of the present invention.

In the cleaning product 51 shown in FIG. 6, the cleaning part 53 comprises the strings 4 and the water-decomposable sheets 6. The water-decomposable sheet 6 is a so-called sheet pulp and is produced by compressing laminated pulp fibers into a sheet form. The sheet pulp maintains the sheet form thereof through the hydrogen bond force between the pulp fibers. Otherwise, in the sheet pulp, the pulp fibers may be adhered to each other through a water-soluble adhesive, such as polyvinyl alcohol (PVA). The sheet pulp has a remarkably larger fiber-weight per square-meter than that of the water-decomposable paper 9 shown in FIG. 8B (the fiber-weight per square-meter thereof is from 10 g/m$^2$ to 30 g/m$^2$), from 500 g/m$^2$ to 1,000 g/m$^2$. The water-decomposable sheet 6 comprising the sheet pulp has a large weight per square-meter, a high density and a high stiffness. By arranging the water-decomposable sheets 6 together with the strings 4 in the cleaning part, the dirt adhered to the surface of the part to be cleaned, such as a toilet bowl or the like can be easily removed by the sheet 6 having a high stiffness, and further, the strings 4 are transformed relatively freely, so that a wider range of the part to be cleaned can be scrubbed out. In addition, every corner of the bowl can be easily cleaned by the strings 4.

When the cleaning product 51 is discarded into a flush toilet after the use thereof, the sheet pulp can be decomposed into individual pulp fibers within a relatively short time.

In the cleaning product 51 shown in FIG. 6, plural sheets (e.g., five sheets to twenty sheets) of the water-decomposable sheet 6 are piled up, and the plural strings 4 are arranged around them. In the holding part 52, the water-decomposable sheets 6 and the strings 4 are adhered to each other through a water-soluble adhesive and around the bundle of the strings 4, the holding material is wound and adhered thereto. In the cleaning part 53, the individual water-decomposable sheets 6 can move independently and the individual strings 4 can move also independently.

The cleaning product 61 shown in FIG. 7 comprises the cleaning part 63 which includes the water-decomposable block 7 and the strings 4.

The water-decomposable block 7 comprises water-dispersible and biodegradable fibers, such as pulp fibers. The water-decomposable block 7 is produced, for example by molding pulp fibers into a three-dimensional form. The production method thereof comprises: a step of dispersing the pulp fibers in water; a step of feeding the dispersion of the pulp-fibers into a concave-shaped mold which is prepared for molding a product in a cylindrical form and in which a porous part for draining is formed at the bottom of the mold; a step of dehydrating the molded article; and a step of drying the molded article by heating. The step of feeding the pulp-fibers dispersion and the step of dehydrating the molded article in the above-noted production method may be replaced by a step of feeding the dispersion of the pulp-fibers into the above-noted mold or into a mold in another form for compression and a step of compressing the molded article by pressurization using a pressing machine after or while dehydrating the molded article. Still another production method of the water-decomposable block 7 comprises: a step of preparing a raw material in a sludge form by mixing pulp fibers, a thickener and a water-soluble adhesive; a step of extrusion-molding the above-prepared raw material using a screw extruder; a step of dehydrating the molded article; and drying the molded article by heating.

In the water-decomposable block 7, the aggregated pulp fibers or the aggregated other fibers are fixed to each other through hydrogen bonding or are adhered to each other by a water-soluble adhesive.

In the cleaning product 61 shown in FIG. 7, the strings 4 are arranged around the water-decomposable block 7 in the cleaning part 63, and the folded parts 4*b* of the strings 4 are turned to the head of the cleaning part 63. In the holding part 62, the base parts of the strings 4 are adhered to the water-decomposable block 7 by a water-soluble adhesive, and around the bundle of the strings 4, the holding material 5 is wound and adhered thereto.

In the cleaning product 61 shown in FIG. 7, since the terminal surface of the water-decomposable block 7 is exposed in the top of the cleaning part 63, by scrubbing the part to be cleaned with the terminal surface of the water-decomposable block 7, the effect of removing the dirt can be enhanced, and by the strings 4 arranged around the water-decomposable block 7, a wider range of the part to be cleaned can be wiped. When the cleaning product 61 is discarded into a flush toilet after the use thereof, the fixing between the water-decomposable block 7 and the strings 4 in the holding part 62 is discharged and the water-decomposable block 7 and the strings 4 are separated from each other. Further, when the water-decomposable block 7 and the strings 4 contact a lot of water, the strings 4 are water-decomposed and the water-decomposable block 7 is decomposed into individual fibers which are dispersed in water within a short time.

Third Embodiment

Figure 9A:
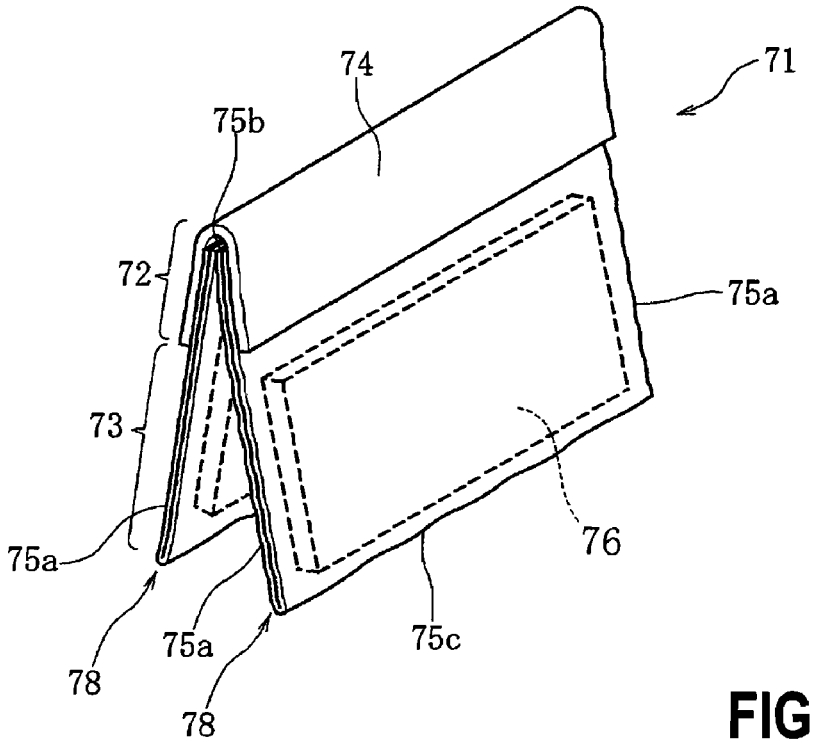
FIG. 9A is a perspective view showing the water-decomposable cleaning product according to the third embodiment of the present invention.
Figure 9B:
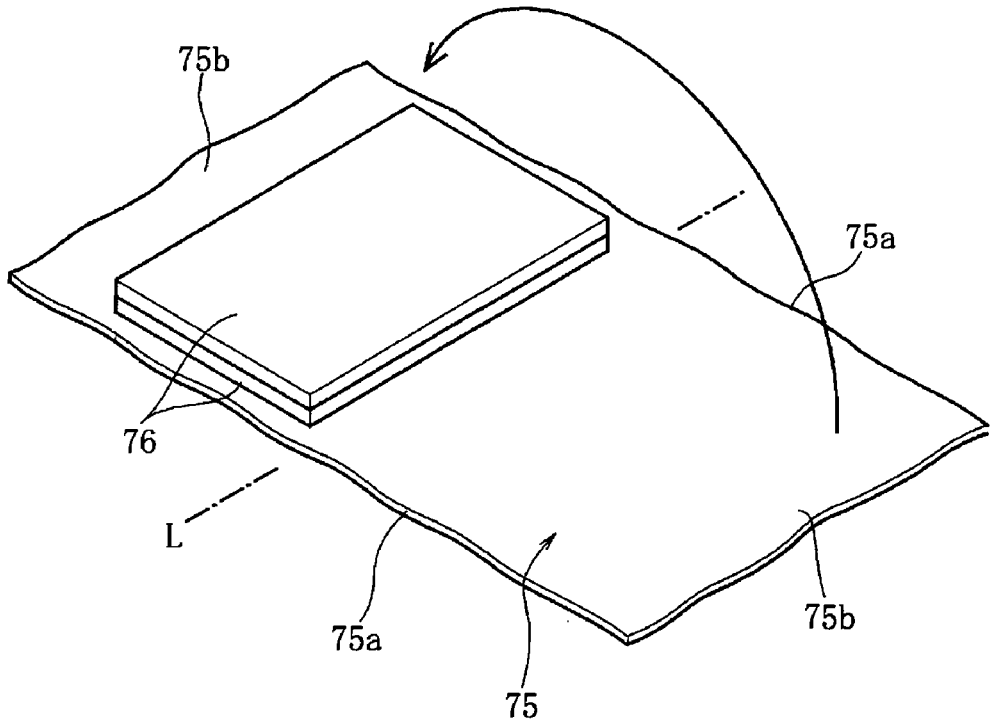
FIG. 9B is a perspective view showing the water-decomposable cleaning product in a developed form of the water-decomposable cleaning product shown in FIG. 9A.

FIG. 9A is a perspective view showing the water-decomposable cleaning product 71 according to the third embodiment of the present invention, and FIG. 9B is a developed perspective view explaining the fundamental structure of the cleaning product 71.

The water-decomposable cleaning product 71 comprises the holding part 72 and the cleaning part 73. The cleaning product 71 comprises at least one cleaning unit 78. According to the third embodiment shown in FIG. 9A and FIG. 9B, two cleaning units 78 are adhered to each other at the upper terminals of the two cleaning units 78 by a water-soluble adhesive, and the holding material 74, such as a water-decomposable paper, covers a part of the two cleaning units 78 over the above-adhered terminals and is adhered to the two cleaning units 78 by a water-soluble adhesive. In the cleaning part 73, the two cleaning units 78 can independently move freely.

FIG. 9B shows a developed structure of the cleaning unit 78. The cleaning unit 78 comprises the water-decomposable outer sheet 75 and the compressed-fiber sheet 76 held in the outer sheet 75. The outer sheet 75 comprises the same fiber-interlacing nonwoven fabric as that which the water-decomposable sheet 8 comprises, wherein the water-decomposable sheet 8 constitutes the twined string 4X shown in FIG. 8A. The preferable range of the formulation of the fiber-interlacing nonwoven fabric constituting the outer sheet 75 and the composition of the fiber used in the fiber-interlacing nonwoven fabric are the same as those in the case of the water-decomposable sheet 8.

The plural compressed-fiber sheets 76 which are piled up are held in the outer sheet 75. The compressed-fiber sheet 76 is produced by laminating water-dispersible fibers having a fiber length of 20 mm or less and by compressing the laminated fibers. Examples of the fibers used for the production of the compressed-fiber sheet 76 include natural fibers, such as pulp fibers and regenerated cellulose fibers, such as rayon fibers. The compressed-fiber sheet 76 in a compressed state can maintain the form of a sheet through the hydrogen bond force of the cellulose fibers and the mechanical bond force between the fibers which is generated by compression. It is also possible that the fibers are connected to each other by a water-soluble adhesive. In this case, the compressed-fiber sheet 76 may comprise synthetic resin fibers, such as PET fibers, PP fibers, PE fibers and nylon fibers. However, the compressed-fiber sheet 76 comprises preferably only biodegradable fibers.

For example, the compressed-fiber sheet 76 comprises only pulp fibers. The pressure used for the compression by which the compressed-fiber structure 76 is produced is 2,000 kPa to 6,000 kPa, for example, 3920 kPa (40 kgf/cm$^2$) and the time for the compression is from 1 sec to 5 sec. The compression is performed at normal temperature and may be performed during heating. For enhancing the hydrogen bond force between the fibers, the fibers may be heated and compressed after water is added to the fibers by the spraying.

Since the compressed-fiber sheet 76 comprises fibers having a fiber length of 20 mm or less, preferably pulp fibers, when the cleaning product 71 is discarded into a flush toilet or the like, the compressed-fiber sheet 76 can be decomposed into individual fibers within a relatively short time. Therefore, the size of the compressed-fiber sheet 76 can be set optionally according to the form of the cleaning product. However, for decomposing the compressed-fiber sheet 76 in water within a short time, it is preferred that when the compressed-fiber sheet 76 contains three times its own weight in water, the compressed-fiber sheet 76 is swollen to at least twice its normal volume. The time needed for the water-decomposition of the compressed-fiber sheet 76 (a measuring method thereof is noted above) is preferably 700 sec or less, more preferably 600 sec or less, still more preferably 300 sec or less. The mass of the compressed-fiber sheet 76 used for the production of one cleaning product 71 is preferably 20 g or less in total. 20 g corresponds to the weight of a toilet paper having a length of 9 m and is in the range where the clogging of the piping is unlikely to be caused in a normal flush toilet.

The compressed-fiber sheet 76 may comprise a cleaning agent, an abrasive, an antimicrobial agent or a perfume.

As shown in FIG. 9B, the plural compressed-fiber sheets 76 are piled up on the developed outer sheet 75 having a rectangle form and the outer sheet 75 is folded along the hypothetical line L. Thereafter, an edge part 75*a* in a longer side of the outer sheet 75 and another edge part 75*a* in a longer side of the outer sheet 75 as well as an edge part 75*a* in another longer side of the outer sheet 75 and another edge part 75*a* in another longer side of the outer sheet 75, are adhered to each other through a water-soluble adhesive without adhering an edge part to the compressed-fiber sheet 76. Further, an edge part 75*b* in a shorter side of the outer sheet 75 and an edge part 75*b* in another shorter side of the outer sheet 75 are adhered to each other by a water-soluble adhesive. Instead of the adhesion using a water-soluble adhesive or as in combination with the adhesion using a water-soluble adhesive, an edge part 75*a* in a longer side, an edge part 75*a* in another longer side and an edge part 75*b* in a shorter side are superimposed on respectively another edge part 75*a* in a longer side, another edge part 75*a* in another longer side and another edge part 75*b* in a shorter side, and the folded outer sheet 75 is pressed, or heated and pressed, so that the above-noted edge parts 75*a* in a longer side, edge parts 75*a* in another longer side and edge parts 75*b* in a shorter side respectively can be adhered to each other through the hydrogen bond force and the mechanical bond force of the outer sheet 75.

The cleaning product 71 shown in FIG. 9A is produced comprising two cleaning units 78 which are adhered to each other through a water-soluble adhesive in the range of the cleaning unit 78 from the edge part 75*b* to a line which is downwards distant along the outer surface of the cleaning unit 78 in parallel from the edge part 75*b* with a predetermined length, with the folded part 75*c* (which is caused by folding the outer sheet 75 along the hypothetical line L) turned downwards, and comprising the holding material 74 adhered and fixed to the adhered cleaning units 78 covering the above-noted adhered range of the adhered cleaning units 78.

The cleaning product 71 is held by a holder in such a manner that the holding part 72 of the cleaning product 71 is supported by the holder. A holder holding the cleaning product 71 is different from the holder 10 shown in FIG. 1 and the holding part 12 and the pressing part 13 of the holder have flat inside surfaces which face to each other. The cleaning product 71 is held by the holder in such a manner that the holding part 72 of the cleaning product 71 is supported between the holding part 12 and the pressing part 13 of the holder. By sliding the cleaning part 73 of the cleaning product 71 upon the part to be cleaned, such as a toilet bowl or the like, the dirt can be removed by the outer sheet 75. Since the cleaning part 73 has flat side surfaces, by sliding the flat side surface of the cleaning part 73 upon the part to be cleaned, a wider area of the part to be cleaned can be cleaned. Since the outer sheet 75 comprises a fiber-interlacing nonwoven fabric, the outer sheet 75 is unlikely to be broken during scrubbing of the part to be cleaned. When the cleaning product 71 contacts water during cleaning, the compressed-fiber sheet 76 in the outer sheet 75 is swollen and exhibits elasticity, so that the part to be cleaned can be scrubbed by the outer sheet 75 with an appropriate pressure.

Since the holding material 74 comprises a water-decomposable paper produced by papermaking pulp fibers or by papermaking pulp fibers and by adhering fibers to each other through a water-soluble adhesive, when the cleaning product 71 is discarded into water after the use thereof, the holding force of the holding material 74 is immediately discharged and the adhered cleaning units 78 are separated into two cleaning units 78. Further, in water, the adhesion between the edge parts 75*a* of the outer sheet 75 and between the edge parts 75*b* of the outer sheet 75 is discharged, and the outer sheet 75 and the compressed-fiber sheet 76 are separated from each other, so that the outer sheet 75 and the compressed-fiber sheet 76 are independently decomposed into individual fibers.

Fourth Embodiment

Figure 10:
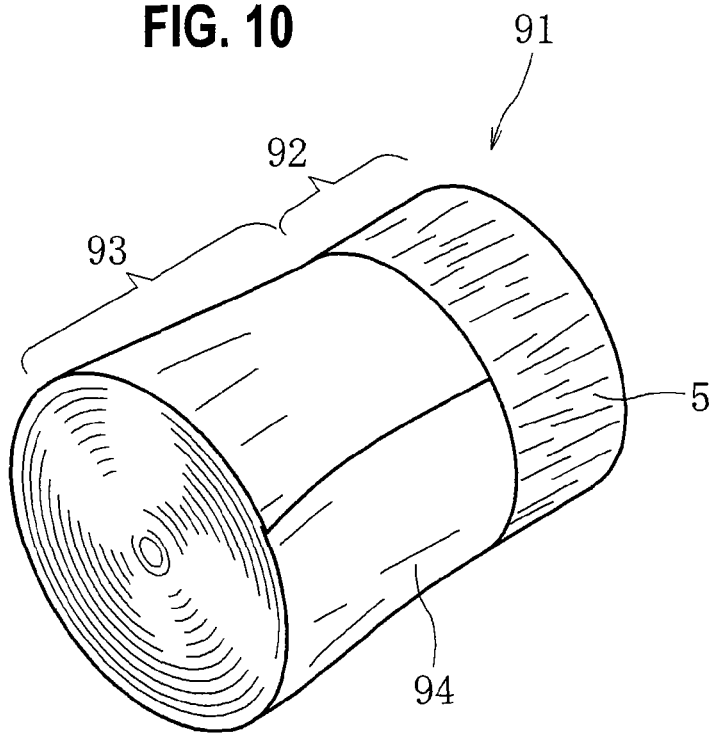
FIG. 10 is a perspective view showing the water-decomposable cleaning product according to the fourth embodiment of the present invention.
Figure 11:
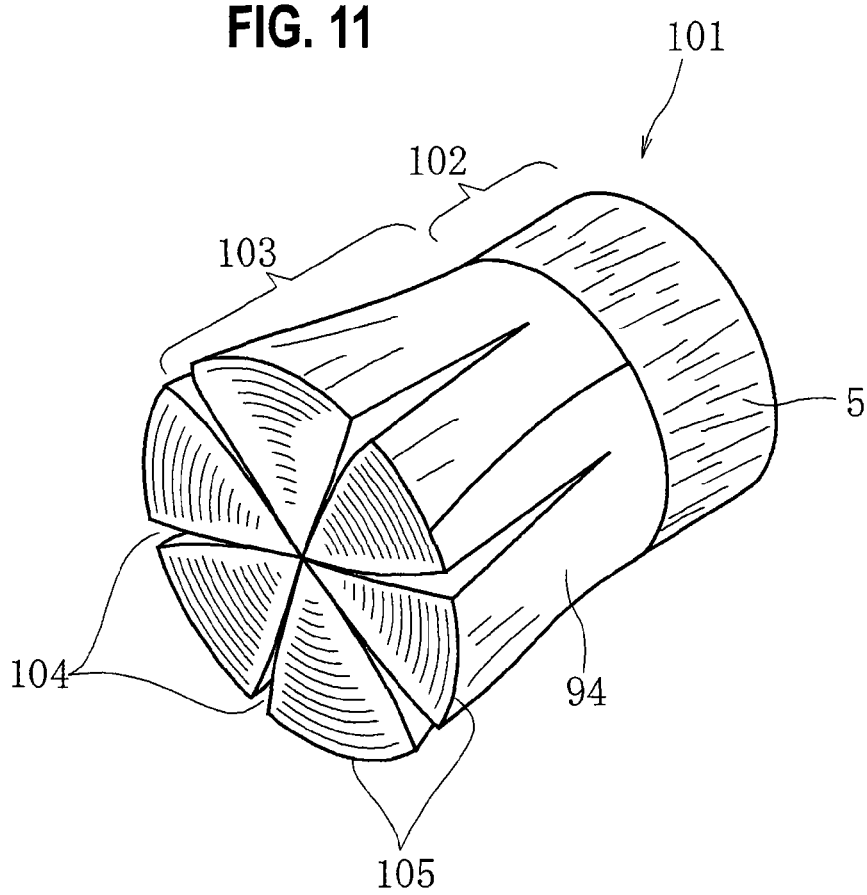
FIG. 11 is a perspective view showing another form of the water-decomposable cleaning product according to the fourth embodiment of the present invention.
Figure 12:
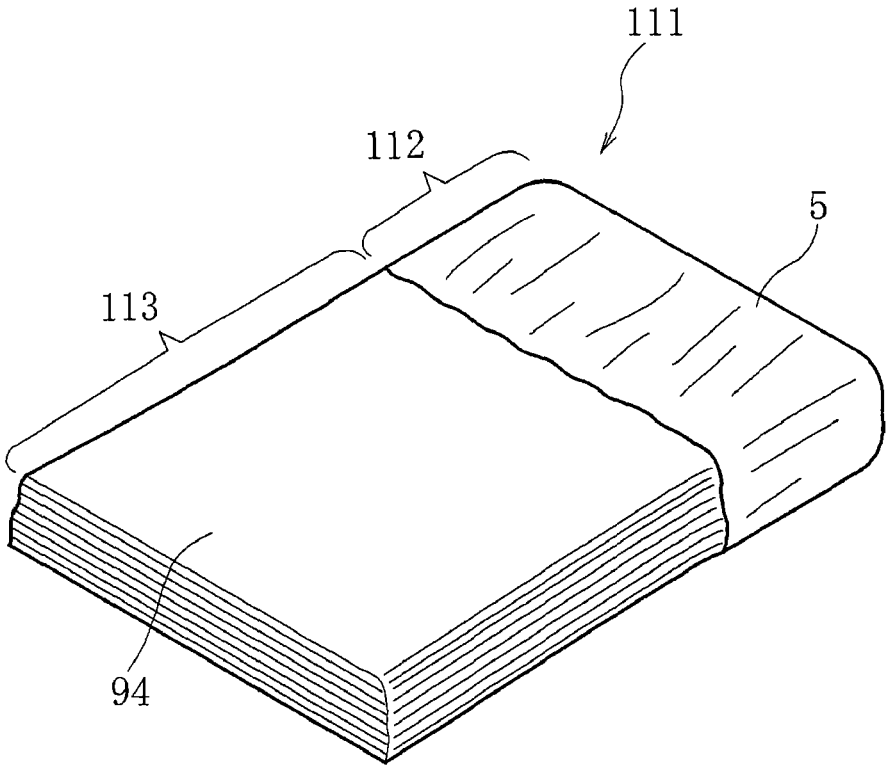
FIG. 12 is a perspective view showing still another form of the water-decomposable cleaning product according to the fourth embodiment of the present invention.

FIG. 10 is a perspective view showing the water-decomposable cleaning product 91 according to the fourth embodiment of the present invention. FIG. 11 and FIG. 12 are perspective views showing the water-decomposable cleaning product according to another form of the fourth embodiment of the present invention.

The cleaning product 91 shown in FIG. 10 comprises the water-decomposable sheet 94 wound into a columnar form. The water-decomposable sheet 94 comprises a water-decomposable fiber-interlacing nonwoven fabric. The preferred range of the formulation of the fiber-interlacing nonwoven fabric and the composition of the fibers constituting the fiber-interlacing nonwoven fabric are the same as those in the case of the water-decomposable sheet 8 shown in FIG. 8A. The water-decomposable sheet 94 is wound tightly and strongly into a columnar form and in the holding part 92 of the cleaning product 91, the holding material 5 which is the same as the holding material 5 used in the cleaning product 1 shown in FIG. 5 is wound around the wound water-decomposable sheet 94. The holding material 5 and the water-decomposable sheet 94 are adhered to each other through a water-soluble adhesive. In the cleaning part 93, the layers of the water-decomposable sheet 94 which are caused by winding the water-decomposable sheet 94 into a columnar form, are not adhered to each other and can move independently and freely.

In winding the water-decomposable sheet 94, by applying a water-soluble adhesive to a surface of the water-decomposable sheet 94, the layers of the water-decomposable sheet 94 may be adhered to each other layer by layer while winding the water-decomposable sheet 94. Otherwise, after the water-decomposable sheet 94 has been wound into a columnar form, the wound water-decomposable sheet 94 may be compressed partially, for example in the form of dots to hydrogen-bond the layers of the water-decomposable sheet 94 partially. Further, the whole of the wound water-decomposable sheet 94 into a columnar form may be compressed to produce the cleaning product 91. Further, the water-decomposable sheet 94 comprising a fiber-interlacing nonwoven fabric and the water-decomposable paper 9 shown in FIG. 8B which are superimposed may be wound together into a columnar form to produce the cleaning product 91.

The holding part 92 is supported between the holding part 12 and the pressing part 13 of the holder 10 shown in FIG. 1 during the use of the cleaning product 91. Since in the cleaning part 93, the water-decomposable sheet 94 is wound multiple-folds and the density of the cleaning part 93 is enhanced, the cleaning part 93 can exhibit a satisfactory stiffness when the part to be cleaned is scrubbed by the water-decomposable sheet 94. In addition, since the water-decomposable sheet 94 comprises a fiber-interlacing nonwoven fabric, the water-decomposable sheet 94 is unlikely to be broken during the cleaning.

When the cleaning product 91 is discarded into a flush toilet after the cleaning, the holding part 5 comprising a water-decomposable paper or the like is peeled and the winding of the water-decomposable sheet 94 in a columnar form is loosened, followed by the decomposition of the water-decomposable sheet 94 in water.

The interface parts between the above-noted layers of the wound water-decomposable sheet 94 may comprise a cleaning agent, an abrasive, an antimicrobial agent or a perfume.

The cleaning product 101 shown in FIG. 11 is produced by a method in which the water-decomposable sheet 94 shown in FIG. 10 is wound into a columnar form and in the holding part 102, the holding material 5 is wound around the wound water-decomposable sheet 94 and is adhered thereto through a water-soluble adhesive. In the cleaning part 103, the water-decomposable sheet 94 wound into a columnar form is cut in directions along the winding axis and plural cuts 104 are formed. As a result, in the cleaning part 103, the water-decomposable sheet 94 is separated into many pieces in a strip form, so that the brush parts 105 are formed. The cuts 104 does not extend to the holding part 102. Therefore, before the cleaning product 101 is held by the holder 10, the pieces in a strip form are not separated from each other. Otherwise, the cleaning part 103 may be formed by a method in which many cuts having a predetermined pitch are formed in the water-decomposable sheet 94 in a belt form and the water-decomposable sheet 94 having many cuts is wound into a columnar form to form the cleaning part 103.

With respect to the cleaning product 101 shown in FIG. 11, when the part to be cleaned, such as a toilet bowl or the like is cleaned by the cleaning part 103, the pieces in a strip form of the water-decomposable sheet 94 constituting the brush part 105 are spread, and the cleaning can be effectively performed by individual pieces in a strip form. When the cleaning product 101 is discarded after the use thereof, the holding material 5 is separated from the cleaning product 101 and the winding of the water-decomposable sheet 94 is relaxed; however, since the cuts 104 are formed in the water-decomposable sheet 94, the water-decomposable sheet 94 can be water-decomposed within a short time.

The water-decomposable cleaning product 111 shown in FIG. 12 is produced by a method in which the water-decomposable sheet 94 is folded multiple-folds forming many layers of the water-decomposable sheet 94 and around the base part of the folded water-decomposable sheet 94, the holding material 5 is wound and adhered thereto through a water-soluble adhesive, so that the flat holding part 112 is formed in the base part. The layers of the folded water-decomposable sheet 94 in the cleaning part 113 may be adhered to each other or may be not adhered to each other.

With respect to the cleaning product 111, the holding part 5 is held by a holder, and the part to be cleaned, such as the surface of a toilet bowl or the like is cleaned by the cleaning part 113 comprising the water-decomposable sheet 94, which comprises a fiber-interlacing nonwoven fabric. In this case, a holder in which the holding part 12 and the pressing part 13 shown in FIG. 1 have flat inside surfaces which face each other is used. Since the water-decomposable sheet 94 comprises a fiber-interlacing nonwoven fabric, the water-decomposable sheet 94 is unlikely to be broken when the water-decomposable sheet 94 is slid upon the part to be cleaned.

In the production of the cleaning product 111 shown in FIG. 12, instead of the folding of the water-decomposable sheet 94, many sheets of the water-decomposable sheet 94 in a rectangular form may be piled up to form the cleaning part 113. In this case, it is also possible that by forming plural cuts in the water-decomposable sheet 94, many pieces in a strip form are formed to form a brush part.

When the outer sheet 75 shown in FIG. 9 and the water-decomposable sheet 94 shown in FIG. 10 to FIG. 12 have a size of 100 mm×100 mm, the time needed for the water-decomposition thereof is preferably 300 sec or less.

Fifth Embodiment

Figure 13:
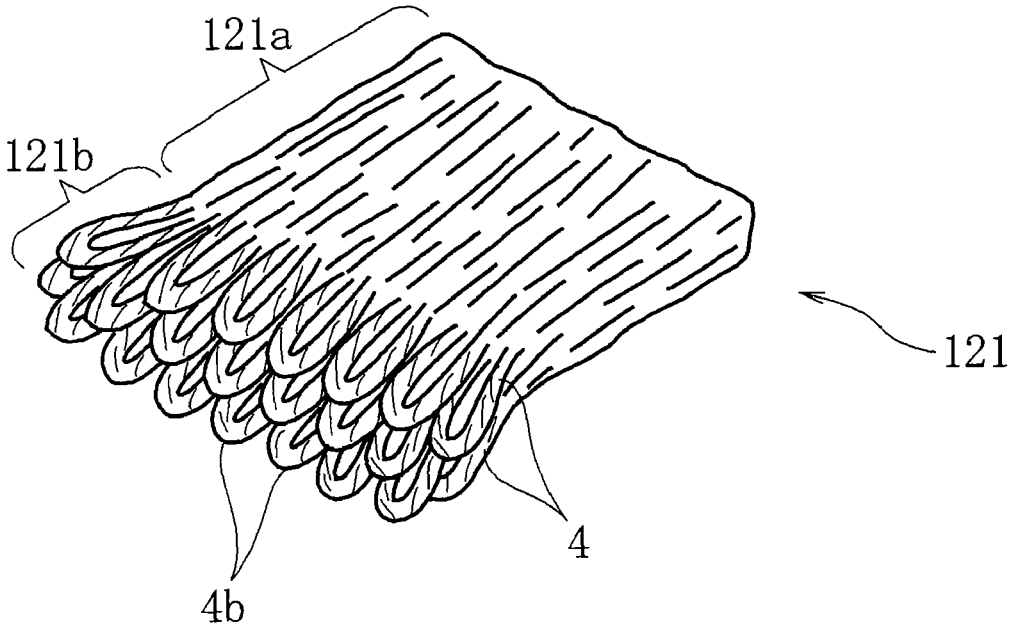
FIG. 13 is a perspective view showing the water-decomposable cleaning product according to the fifth embodiment of the present invention.

FIG. 13 is a perspective view showing the water-decomposable cleaning product 121 according to the fifth embodiment of the present invention.

The cleaning product 121 is produced by bundling-up the strings 4 which are folded into halves. The strings 4 are the same as those shown in FIG. 2 to FIG. 7. While bundling-up the strings 4, a base side part of the bundle of the strings 4 is compressed to form the compressed part 121*a*. In the non-compressed part 121*b*, the folded parts 4*b* of the strings 4 are not compressed, i.e. are in a free state. The compressed part 121*a* maintains a compressed state through the mechanical bond force and the hydrogen bond force of plural strings 4 comprising a water-decomposable fiber-interlacing nonwoven fabric.

Since in the cleaning product 121, the strings 4 are not separated from each other in a dry state, the cleaning product 121 can maintain the product form thereof in a dry state. In this case, as the holder, a holder in which the holding part 12 and the pressing part 13 shown in FIG. 1 have flat inside surfaces which face each other is used. The whole part of the cleaning product 121 may be compressed.

In the cleaning products according to the above-noted other embodiments, only the holding part or both the holding part and the cleaning part may be compressed.

EXAMPLES

As shown in the following Table 1, fiber-interlacing nonwoven fabrics have been prepared in Examples 1 to 5. Further, the twined strings 4X shown in FIG. 8A were formed using the fiber-interlacing nonwoven fabrics of Examples 1 to 4. The fiber-interlacing nonwoven fabrics of Examples 1 to 5 were prepared using needle-leaved tree bleached kraft pulp fibers (NBKP) and viscose rayon fibers having a titer of 1.1 dtex and a fiber length of 7 mm. As the composition ratios (% by mass) of NBKP fibers and viscose rayon fibers are shown in Table 1, the composition ratios of NBKP fibers were 95% by mass in Example 1, 90% by mass in Example 2, 50% by mass in Example 3, 10% by mass in Example 4, and 5% by mass in Example 5. The remainder in each Example was viscose rayon fibers. All of the fiber-interlacing nonwoven fabrics of Examples 1 to 5 had a fiber-weight per square-meter of 50 g/m$^2$.

The fiber-interlacing nonwoven fabrics of Examples 1 to 5 were prepared by a method in which fiber webs were paper-made on a porous plastic wire and without drying fiber webs, fibers were interlaced by applying a jet stream to the fiber webs using a high-pressure waterjet injecting apparatus. The high-pressure waterjet injecting apparatus in which one nozzle has an opening diameter of 95 μm and 2,000 nozzles are lined up with a pitch of 0.5 mm in the cross direction which crosses the machine direction of the fiber webs orthogonally, was used. While conveying the fiber webs with a speed of 30 m/min, a treating energy per an area unit of 0.24682 kW/m$^2$ was applied to the fiber webs using the high-pressure water jet injecting apparatus. This water jet treatment was repeated twice in substantially the same conditions and thereafter, the fiber webs were dried using a Yankee drying drum.

The thickness and the fiber density of the obtained fiber-interlacing nonwoven fabric are shown in the columns "Thickness" and "Density" of the column "Properties of fiber-interlacing nonwoven fabric" in Table 1.

The fiber-interlacing nonwoven fabrics of Examples 1 to 5 were cut into a size of 150 mm in the machine direction (MD) of the fiber webs and 25 mm in the cross direction (CD) which crosses the machine direction orthogonally to obtain the samples for the measurement of the properties and with respect to the thus obtained samples, the dry strength and the wet strength of the fiber-interlacing nonwoven fabric were measured. The measurement was performed through a tensile test in which the sample is held between the chucks of a tension tester so that the length of the sample in the longitudinal direction is 100 mm, and the distance between the chucks are expanded with a speed of 100 mm/min, thereby measuring the breaking strength (N/25 mm) of the sample as the maximum load which has been applied to the sample until the sample is broken.

The dry strength is the result of the tensile test performed with respect to the sample in a dry state and the wet strength is the result of the tensile test performed with respect to the sample which has been immersed in an ion-exchanged water for 10 sec. This tensile test was performed in an atmosphere having a room temperature of 25° C. and a relative humidity of 65%. The measured values are shown in the columns "Dry strength" and "Wet strength" of the column "Properties of fiber-interlacing nonwoven fabric" in Table 1.

Next, the water-decomposable sheets of Examples 1 to 4 were cut into a belt form having a size in the CD of 50 mm and by twining the resultant sheets as shown in FIG. 8A, the twined strings 4X were formed. The number of the twinings was 17 times per 25 cm of the cut water-decomposable sheets in every cut water-decomposable sheet. The width and the density of the twined strings 4X are shown in the columns "String width" and "Density" of the column "Properties after the twining". The twined strings 4X were subjected to a tensile test under the same conditions as those in the above-noted tensile test for the fiber-interlacing nonwoven fabrics, thereby measuring the breaking strength of the twined strings 4X.

In measuring the wet strength of the twined string 4X, after the twined string 4X which is held between the chucks of a tension tester without loosening the twined string 4X was immersed in an ion-exchanged water for 10 sec, the resultant twined string 4X was subjected to a tensile test. The results of the measurement are shown in the columns "Dry strength" and "Wet strength" of the column "Properties after the twining" in Table 1.

The measurement of the water-decomposability was performed according to the measuring method explained in the section of the embodiments of the present invention. With respect to the samples prepared by cutting the fiber-interlacing nonwoven fabrics of Examples 1 to 5 into a size of 100 mm×100 mm, the time needed for the water-decomposition was measured. Also, with respect to the samples prepared by cutting the strings of Examples 1 to 4 into a length of 100 mm, the time needed for the water-decomposition was measured. The results of the measurement are shown in the column "Water-decomposability" in Table 1.

TABLE 1

| Items | | | Example 1 | Example 2 | Example 3 | Example 4 | Example 5 |
|---|---|---|---|---|---|---|---|
| Composition | Pulp | NBKP | 95% | 90% | 50% | 10% | 5% |
| | Viscose rayon | 1.1 detx × 7 mm | 5% | 10% | 50% | 90% | 95% |
| W.J.*1 treatment energy/1 time | | $KW/m^2$ | 0.24682 | 0.24682 | 0.24682 | 0.24682 | 0.24682 |
| W.J.*1 treatment times | | times | 2 | 2 | 2 | 2 | 2 |
| Properties of fiber-interlacing nonwoven fabric | | | | | | | |
| Weight per square-meter | | $g/m^2$ | 50.0 | 50.0 | 50.0 | 50.0 | 50.0 |
| Thickness | | mm | 0.24 | 0.25 | 0.33 | 0.45 | 0.47 |
| Density | | $g/cm^3$ | 0.208 | 0.200 | 0.152 | 0.111 | 0.106 |
| Dry strength | | N/25 mm | 22.41 | 18.01 | 9.86 | 7.01 | 6.30 |
| Wet strength | | N/25 mm | 0.81 | 1.04 | 2.43 | 5.35 | 6.02 |
| Water-decomposability (time for W.d.*2) | | sec | 24 | 36 | 77 | 94 | 118 |
| Properties after the twining | | | | | | | |
| Sheet width | | mm | 50 | 50 | 50 | 50 | |
| Twining times | | times/25 cm | 17 | 17 | 17 | 17 | |
| String width | | mm | 2.0 | 2.2 | 3.5 | 4.0 | |
| Density | | $g/cm^3$ | 0.796 | 0.658 | 0.260 | 0.199 | |
| Dry strength | | N | 82.96 | 66.96 | 45.42 | 25.83 | |
| Wet strength | | N | 3.94 | 8.77 | 16.49 | 42.80 | |
| Water-decomposability (time for W.d.*2) | | sec | 30 | 60 | 83 | 123 | |

*1"W.J. "means "Water Jet"
*2"W.d. "means "Water-decomposition"

Among the Examples shown in Table 1, particularly in Examples 2 to 4, the fiber-interlacing nonwoven fabrics had a high dry strength (7.0 N/25 mm or more) and a high wet strength (1.0 N/25 mm or more). In Examples 2 to 4, the twined string could be easily formed by twisting, and during twining, the strings were not cut or broken. Further, in Examples 2 to 4, a high wet strength of the twined string of 8 N or more could be obtained. With respect to the time needed for the water-decomposition of the fiber-interlacing nonwoven fabric, the best value in Examples 1 to 4 and the value measured in Example 5 were 94 sec and 118 sec respectively and all values measured in Examples 1 to 5 were 300 sec or less. Among the twined strings which were formed in Examples 1 to 4, the highest value of the time needed for the water-decomposition of the twined string was 123 sec.

All of the fiber-interlacing nonwoven fabrics and the twined strings 4X which were produced in Examples 1 to 5 can be used for producing the cleaning product; however, for producing the fiber-interlacing nonwoven fabric having a dry strength of 7.0 N/25 mm or more, the fiber-interlacing nonwoven fabric is produced preferably comprising 10% by mass or more of pulp fibers. Further, for producing the fiber-interlacing nonwoven fabric having a wet strength of 1.0 N/25 mm or more and for producing the twined string 4X having a wet strength of 8.0 N/25 mm or more, the fiber-interlacing nonwoven fabric is produced preferably comprising 10% by mass or more of rayon fibers.

In Examples A to F shown in Table 2, the fiber-interlacing nonwoven fabrics were produced by a method comprising: papermaking fiber webs comprising 50% by mass of NBKP fibers and 50% by mass of viscose rayon fibers (having a titer of 1.1 dtex and a fiber length of 7 mm); and subjecting the resultant fiber webs to a water jet treatment under the same conditions as those used in Examples 1 to 5. The fiber weights per square-meter of the fiber-interlacing nonwoven fabrics produced in Examples A to F were set to respectively 15.0 g/m$^2$, 20.0 g/m$^2$, 50.0 g/m$^2$, 100.0 g/m$^2$, 120.0 g/m$^2$ and 50.0 g/m$^2$. The thickness and the density of the fiber-interlacing nonwoven fabrics are shown in the columns "Thickness" and "Density" of the column "Properties of fiber-interlacing nonwoven fabric" in Table 2. The dry strength, the wet strength and the time needed for the water-decomposition of the fiber-interlacing nonwoven fabric were measured in substantially the same manner as in Examples 1 to 5. The results of the measurement are shown in the columns "Dry strength", "Wet strength" and "Water-decomposability" of the column "Properties of fiber-interlacing nonwoven fabric" in Table 2.

Further, using the water-decomposable sheets produced in Examples A to F, the same twinned strings as that shown in FIG. 8A were formed. In forming every twined string, a water-decomposable sheet having a width of 50 mm was used and the times of the twining were differentiated per Example. The times of the twining per 25 cm of the water-decomposable sheets produced in Examples A to F were set to respectively 18 times, 18 times, 17 times, 16 times, 16 times and 4 times. The width and the density of the twined string are shown in the columns "String width" and "Density" of the column "Properties after the twining" in Table 2. The dry strength, the wet strength and the time needed for the water-decomposition of the twined string were measured in substantially the same manner as in Examples 1 to 4. The results of the measurement are shown in the columns "Dry strength", "Wet strength" and "Water-decomposability" of the column "Properties after the twining" in Table 2.

TABLE 2

| Items | | | Example A | Example B | Example C | Example D | Example E | Example F |
|---|---|---|---|---|---|---|---|---|
| Composition | Pulp | NBKP | | | 50% | | | |
| | Viscose rayon | 1.1 detx × 7 mm | | | 50% | | | |
| W.J. treatment energy/1 time | | KW/m$^2$ | 0.24682 | 0.24682 | 0.24682 | 0.24682 | 0.24682 | 0.24682 |
| W.J. treatment times | | times | 2 | 2 | 2 | 2 | 2 | 2 |
| Properties of fiber-interlacing nonwoven fabric | | | | | | | | |
| Weight per square-meter | | g/m$^2$ | 15.0 | 20.0 | 50.0 | 100.0 | 120.0 | 50.0 |
| Thickness | | mm | 0.22 | 0.24 | 0.33 | 0.54 | 0.61 | 0.33 |
| Density | | g/cm$^3$ | 0.068 | 0.083 | 0.152 | 0.185 | 0.197 | 0.152 |
| Dry strength | | N/25 mm | 0.551 | 0.727 | 9.86 | 28.26 | 35.15 | 9.86 |
| Wet strength | | N/25 mm | 0.194 | 0.341 | 2.43 | 7.46 | 9.33 | 2.43 |
| Water-decomposability (time for W.d.) | | sec | 8 | 19 | 77 | 184 | 345 | 77 |
| Properties after the twining | | | | | | | | |
| Sheet width | | mm | 50 | 50 | 50 | 50 | 50 | 50 |
| Twining times | | times/25 cm | 18 | 18 | 17 | 16 | 16 | 4 |
| String width | | mm | 2.8 | 2.9 | 3.5 | 4.6 | 5.0 | 5.0 |
| Density | | g/cm$^3$ | 0.122 | 0.151 | 0.260 | 0.301 | 0.306 | 0.127 |
| Dry strength | | N | 1.87 | 2.41 | 45.42 | 84.78 | 108.9 | 10.11 |
| Wet strength | | N | 1.16 | 2.16 | 16.49 | 46.25 | 75.57 | 3.44 |
| Water-decomposability (time for W.d.) | | sec | 22 | 41 | 83 | 276 | 643 | 80 |

From the results shown in Table 2, for maintaining a high dry strength of the water-decomposable sheet and a high wet strength of the twined string, the water-decomposable sheet has a fiber weight per square-meter of preferably 30 g/m$^2$ or more. Further, so that the time needed for the water-decomposition of the fiber-interlacing nonwoven fabric is 400 sec or less and so that the time needed for the water-decomposition of the twined string is 700 sec or less, the water-decomposable sheet has a fiber weight per square-meter of preferably 120 g/m$^2$ or less. The times of the twining per 25 cm of the sheet for enhancing the wet strength of the twined string is at least 4 times or more, preferably 10 times or more. The upper limit of the times of the twining is particularly not limited so long as the sheet is not broken; however, the preferable upper limit is around 30 times.

Since in the water-decomposable cleaning product according to the present invention, the cleaning part comprises a water-decomposable fiber-interlacing nonwoven fabric, when the cleaning is performed by the cleaning product which is wetted, the cleaning part neither is broken nor looses the form thereof, so that the dirt can be effectively removed by the cleaning product. Moreover, when the cleaning product is discarded into water after the use thereof, the interlacing of the fibers is loosened, so that the cleaning product becomes able to be easily water-decomposed.

By the production method of the water-decomposable cleaning product according to the present invention, the cleaning part having a high density and a high wet strength can be produced.

Although the present invention has been described above by reference to certain embodiments, the present invention is not limited to the embodiments described above. Modifications and variations of the embodiments described above will occur to those skilled in the art, in light of the above teachings.

The scope of the preset invention is defined with reference to the following claims.

What is claimed is:

1. A water-decomposable toilet cleaning brush configured to be coupled to a holder having a handle which water-decomposable toilet cleaning brush comprises:

a cleaning part, at least a part of the cleaning part including a string formed by twining a water-decomposable fiber-interlacing nonwoven fabric; and a holding part comprising water-decomposable fiber-interlacing nonwoven fabrics that are adhered with a water-soluble adhesive, wherein the fiber-interlacing nonwoven fabric of each of the cleaning part and the holding part is decomposable in water in no greater than 700 seconds, wherein the water-decomposable cleaning brush is sufficiently small to allow the water-decomposable cleaning brush to be discarded by flushing the water-decomposable cleaning brush down a standard toilet after water decomposition, and wherein the string formed by twining the water-decomposable fiber-interlaced nonwoven fabric remains sufficiently stiff after bean wetted b water and before decomposition to perform a scrubbing action.

2. The water-decomposable toilet cleaning brush product as claimed in claim 1, wherein the fiber-interlacing nonwoven fabric includes fibers each having a length of 20 mm or less.

3. The water-decomposable toilet cleaning brush as claimed in claim 1, wherein the fiber-interlacing nonwoven fabric includes:

natural fibers, and interlaceable fibers each having a length of 20 mm or less.

4. The water-decomposable toilet cleaning brush as claimed in claim 3, wherein the natural fibers are pulp fibers, and the fiber-interlacing nonwoven fabric includes:

between 10% by mass and 90% by mass of the pulp fibers and between 10% by mass and 90% by mass of the interlaceable fibers.

5. The water-decomposable toilet cleaning brush as claimed in claim 3, wherein the interlaceable fibers are rayon fibers.

6. The water-decomposable toilet cleaning brush product as claimed in claim 1, wherein the string includes:

the fiber-interlacing nonwoven fabric and a water-decomposable paper including cellulose fibers.

7. The water-decomposable toilet cleaning brush product as claimed in claim 1, wherein the string is compressed.

8. The water-decomposable toilet cleaning brush as claimed in claim 1, wherein the cleaning part includes a brush part formed by the fiber-interlacing nonwoven fabric in a strip form.

9. The water-decomposable toilet cleaning brush as claimed in claim 1, wherein the cleaning part includes the fiber-interlacing nonwoven fabric which is subjected to bundling up to thereafter form a part of the water-decomposable cleaning product.

10. A method for manufacturing a water-decomposable toilet cleaning brush, which method comprises:

forming each of a plurality of strings by twining a water-decomposable fiber-interlacing nonwoven fabric; and arranging the plurality of strings in a cleaning part and adhering at least a part of the strings to each other with a water soluble adhesive so as to form a holding part, wherein the fiber-interlacing nonwoven fabric is decomposable in water in no greater than 700 seconds, wherein the water-decomposable cleaning brush is sufficiently small to allow the water-decomposable cleaning brush to be discarded by flushing the water-decomposable cleaning brush down a standard toilet after water decomposition, and wherein the plurality of strings formed by twining the water-decomposable fiber-interlaced nonwoven fabric remain sufficiently stiff after being wetted by water and before decomposition to perform a scrubbing action.

11. The method for manufacturing of a water-decomposable toilet cleaning brush as claimed in claim 10, wherein the fiber-interlacing nonwoven fabric includes:

between 10% by mass and 90% by mass of pulp fibers, and between 10% by mass and 90% by mass of interlaceable fibers.

12. A water-decomposable toilet cleaning brush configured to be coupled to a holder having a handle which water-decomposable toilet cleaning brush comprises:

a cleaning part, at least a part of the cleaning part including a string formed by twining a water-decomposable fiber-interlacing nonwoven fabric; and a holding part comprising water-decomposable fiber-interlacing nonwoven fabrics, the water-decomposable fiber-interlacing nonwoven fabrics being compressed in the holding part, wherein the fiber-interlacing nonwoven fabrics of each of the cleaning part and the holding part is decomposable in water in no greater than 700 seconds, wherein the water-decomposable cleaning brush is sufficiently small to allow the water-decomposable cleaning brush to be discarded by flushing the water-decomposable cleaning brush down a standard toilet after water decomposition, and wherein the string formed by twining the water-decomposable fiber-interlaced nonwoven fabric remains sufficiently stiff after bean wetted by water and before decomposition to perform a scrubbing action.

* * * * *

UNITED STATES PATENT AND TRADEMARK OFFICE

CERTIFICATE OF CORRECTION

PATENT NO. : 7,943,538 B2
APPLICATION NO. : 11/383028
DATED : May 17, 2011
INVENTOR(S) : Takayoshi Konishi and Kazuya Okada It is certified that error appears in the above-identified patent and that said Letters Patent is hereby corrected as shown below:

In the Claims

Claim 1, column 21, line 11, should be changed from:
"ciently stiff after bean wetted b water and before decomp-"
and replaced with
-- ciently stiff after being wetted by water and before decomp- --

Claim 12, column 22, line 44 should be changed from
"ciently stiff after bean wetted by water and before"
and replaced with
-- ciently stiff after being wetted by water and before --

Signed and Sealed this
Fourth Day of October, 2011

David J. Kappos

David J. Kappos
*Director of the United States Patent and Trademark Office*